US011982169B2

(12) United States Patent
Cui et al.

(10) Patent No.: US 11,982,169 B2
(45) Date of Patent: May 14, 2024

(54) FRACTURING DEVICE DRIVEN BY A VARIABLE-FREQUENCY ADJUSTABLE-SPEED INTEGRATED MACHINE AND A WELL SITE LAYOUT

(71) Applicant: YANTAI JEREH PETROLEUM EQUIPMENT & TECHNOLOGIES CO., LTD., Yantai (CN)

(72) Inventors: Shuzhen Cui, Yantai (CN); Sheng Chang, Yantai (CN); Dawei Zhao, Yantai (CN); Shouzhe Li, Yantai (CN); Liang Lv, Yantai (CN); Xincheng Li, Yantai (CN)

(73) Assignee: YANTAI JEREH PETROLEUM EQUIPMENT & TECHNOLOGIES CO., LTD., Yantai (CN)

( * ) Notice: Subject to any disclaimer, the term of this patent is extended or adjusted under 35 U.S.C. 154(b) by 0 days.

(21) Appl. No.: 17/970,346

(22) Filed: Oct. 20, 2022

(65) Prior Publication Data

US 2023/0121251 A1 Apr. 20, 2023

Related U.S. Application Data

(63) Continuation of application No. PCT/CN2022/101889, filed on Jun. 28, 2022.

(30) Foreign Application Priority Data

Oct. 14, 2021 (CN) ..... 202111198446.6

(51) Int. Cl.

| | |
|---|---|
| ***E21B 43/26*** | (2006.01) |
| ***F04B 17/03*** | (2006.01) |
| ***F04B 17/06*** | (2006.01) |

(52) U.S. Cl.
CPC ..... *E21B 43/2607* (2020.05); *F04B 17/03* (2013.01); *F04B 17/06* (2013.01)

(58) Field of Classification Search
CPC ..... E21B 43/2607; E21B 43/26; F04B 17/03; F04B 17/06; F04B 9/02; F04B 47/02;
(Continued)

(56) References Cited

U.S. PATENT DOCUMENTS

| | | | |
|---|---|---|---|
| 3,053,163 | A | 9/1962 | Schofield |
| 3,794,377 | A | 2/1974 | Wachsmuth et al. |

(Continued)

FOREIGN PATENT DOCUMENTS

| | | | |
|---|---|---|---|
| CA | 2900387 | A1 | 10/2012 |
| CN | 100999188 | A | 7/2007 |

(Continued)

OTHER PUBLICATIONS

Non-Final Office Action for U.S. Appl. No. 17/884,358 dated Dec. 8, 2022.

(Continued)

*Primary Examiner* — James G Sayre

(57) ABSTRACT

The present disclosure provides a fracturing device driven by a variable-frequency adjustable-speed integrated machine (VFASIM), including the VFASIM and a plunger pump. The VFASIM includes a driving device for providing a driving force and an inverting device integrally installed on the driving device. The inverting device supplies power to the driving device. The plunger pump is integrally installed together with the VFASIM, the plunger pump is mechanically connected to the driving device of the VFASIM and driven by the driving device. According to the present disclosure, it is possible to achieve an overall layout (Continued)

with a high degree of integration. The present disclosure also provides a well site layout including a plurality of fracturing devices described above.

18 Claims, 22 Drawing Sheets

(58) Field of Classification Search
CPC ..... F04B 49/20; F04B 15/02; F04B 53/08; F04B 53/16
See application file for complete search history.

(56) References Cited

U.S. PATENT DOCUMENTS

| | | | |
|---|---|---|---|
| 3,815,965 | A | 6/1974 | Ostwald |
| 4,201,523 | A | 5/1980 | Olofsson |
| 4,793,775 | A | 12/1988 | Peruzzi |
| 5,282,722 | A | 2/1994 | Beatty |
| 5,846,056 | A | 12/1998 | Dhindsa et al. |
| 6,134,878 | A | 10/2000 | Amako et al. |
| 7,036,310 | B2 | 5/2006 | Aoki et al. |
| 7,708,538 | B2 | 5/2010 | Kawabata et al. |
| 8,731,793 | B2 | 5/2014 | Barbir et al. |
| 8,937,415 | B2 | 1/2015 | Shimono |
| 9,863,476 | B2 | 1/2018 | Gray et al. |
| 10,610,842 | B2 | 4/2020 | Chong |
| 10,648,311 | B2 | 5/2020 | Oehring et al. |
| 10,801,311 | B1 | 10/2020 | Cui et al. |
| 10,865,624 | B1 | 12/2020 | Cui et al. |
| 10,914,155 | B2 | 2/2021 | Oehring et al. |
| 11,109,508 | B1 | 8/2021 | Yeung et al. |
| 11,125,066 | B1 | 9/2021 | Yeung et al. |
| 11,208,878 | B2 | 12/2021 | Oehring et al. |
| 11,220,895 | B1 | 1/2022 | Yeung et al. |
| 11,378,008 | B2 | 7/2022 | Yeung et al. |
| 11,391,136 | B2 | 7/2022 | Coli et al. |
| 11,434,737 | B2 | 9/2022 | Oehring et al. |
| 11,459,863 | B2 | 10/2022 | Robinson et al. |
| 2003/0064858 | A1 | 4/2003 | Saeki et al. |
| 2005/0093496 | A1 | 5/2005 | Tokunou et al. |
| 2007/0273220 | A1 | 11/2007 | Koyama et al. |
| 2010/0135840 | A1 | 6/2010 | Fujimoto et al. |
| 2011/0061411 | A1 | 3/2011 | Kim et al. |
| 2013/0255153 | A1 | 10/2013 | Sasaki et al. |
| 2013/0306322 | A1 | 11/2013 | Sanborn et al. |
| 2014/0138079 | A1 | 5/2014 | Broussard et al. |
| 2014/0219824 | A1 | 8/2014 | Burnette |
| 2014/0239858 | A1 | 8/2014 | Bertotto et al. |
| 2016/0041066 | A1 | 2/2016 | Patenaude et al. |
| 2016/0177675 | A1 | 6/2016 | Morris et al. |
| 2016/0348479 | A1 | 12/2016 | Oehring et al. |
| 2017/0051732 | A1 | 2/2017 | Hemandez et al. |
| 2017/0285062 | A1 | 10/2017 | Kim |
| 2017/0292789 | A1 | 10/2017 | Hjorth et al. |
| 2017/0302135 | A1 | 10/2017 | Cory |
| 2018/0159403 | A1 | 6/2018 | Yokoyama et al. |
| 2018/0326337 | A1 | 11/2018 | Esenwein et al. |
| 2018/0328157 | A1 | 11/2018 | Bishop |
| 2019/0010793 | A1 | 1/2019 | Hinderliter |
| 2019/0100989 | A1 | 4/2019 | Stewart et al. |
| 2019/0128265 | A1 | 5/2019 | Washio et al. |
| 2019/0169971 | A1 | 6/2019 | Oehring et al. |
| 2019/0195292 | A1 | 6/2019 | Pan et al. |
| 2020/0040878 | A1 | 2/2020 | Morris |
| 2020/0049136 | A1 | 2/2020 | Stephenson |
| 2020/0109616 | A1 | 4/2020 | Oehring et al. |
| 2020/0300246 | A1 | 9/2020 | Sadakata et al. |
| 2020/0325760 | A1 | 10/2020 | Markham |
| 2020/0378232 | A1 | 12/2020 | Sharp et al. |
| 2021/0040830 | A1 | 2/2021 | Mu et al. |
| 2021/0040836 | A1 | 2/2021 | Baskin |
| 2021/0095552 | A1 | 4/2021 | Oehring et al. |
| 2021/0095648 | A1 | 4/2021 | Buckley et al. |
| 2021/0102451 | A1 | 4/2021 | Robinson et al. |
| 2021/0102530 | A1 | 4/2021 | Pruitt et al. |
| 2021/0199161 | A1 | 7/2021 | Eto et al. |
| 2021/0310341 | A1 | 10/2021 | Sherman et al. |
| 2022/0018232 | A1 | 1/2022 | Oehring et al. |
| 2022/0112892 | A1 | 4/2022 | Cui et al. |
| 2022/0213777 | A1 | 7/2022 | Cui et al. |
| 2022/0298906 | A1* | 9/2022 | Zhong ..... F04B 39/0284 |
| 2022/0364448 | A1 | 11/2022 | Oehring et al. |

FOREIGN PATENT DOCUMENTS

| | | | | |
|---|---|---|---|---|
| CN | 201549965 | U | 8/2010 | |
| CN | 102602322 | A | 7/2012 | |
| CN | 109882144 | A | 6/2019 | |
| CN | 110107490 | A | 8/2019 | |
| CN | 110118127 | A | 8/2019 | |
| CN | 110152552 | A | 8/2019 | |
| CN | 110155193 | A | 8/2019 | |
| CN | 110252191 | A | 9/2019 | |
| CN | 110513097 | A | 11/2019 | |
| CN | 210889387 | U | 6/2020 | |
| CN | 111525736 | A | 8/2020 | |
| CN | 211201920 | U | 8/2020 | |
| CN | 211530941 | U | 9/2020 | |
| CN | 111799903 | A | 10/2020 | |
| CN | 112127863 | A | 12/2020 | |
| CN | 112127863 | A * | 12/2020 | ..... E21B 43/26 |
| CN | 112311297 | A | 2/2021 | |
| CN | 112383190 | A | 2/2021 | |
| CN | 112467899 | A | 3/2021 | |
| CN | 212649313 | U | 3/2021 | |
| CN | 212749608 | U | 3/2021 | |
| CN | 112983382 | A | 6/2021 | |
| CN | 113513462 | A | 10/2021 | |
| CN | 214330604 | U | 10/2021 | |
| CN | 215292784 | U | 12/2021 | |
| CN | 114109335 | A | 3/2022 | |
| CN | 114553062 | A | 5/2022 | |
| JP | 4096267 | B2 | 6/2008 | |

OTHER PUBLICATIONS

Final Office Action for U.S. Appl. No. 17/733,922 dated Dec. 28, 2022.

Notice of Allowance for U.S. Appl. No. 17/884,358 dated Feb. 8, 2023.

Written Opinion and International Search Report for PCT Application No. PCT/CN2022/101889 dated Sep. 7, 2022.

First Search Report for Chinese Application No. 202111198446.6 dated Mar. 15, 2023.

Search Report for Chinese Application No. 202111198446.6 dated May 25, 2023.

Written Opinion and International Search Report for PCT Application No. PCT/CN2021/113988 dated Apr. 28, 2022.

Written Opinion of the International Searching Authority and International Search Report for PCT Application No. PCT/CN2019/114303 dated Aug. 3, 2020.

"Kilowatts to horsepower conversion," RapidTables, retrieved from: https://www.rapidtables.com/convert/power/kw-to-hp.html—Kilowatts to horsepower (hp) conversion calculator, retrieved on May 6, 2020.

Quintuplex—PowerZone, retrieved from: https://www.powerzone.com/resources/glossary/quintuplex#:-: text=A%20reciprocating%20pump%20design%20which,pump%20used%20across%20many%20industries.&text=Dual%20action%20quintuplex%20pumps%20can,rare%20and%20usually%20custom%20manufactured, retrieved on Aug. 18, 2020.

Final Office Action for U.S. Appl. No. 16/833,496 dated Aug. 28, 2020.

Non-Final Office Action for U.S. Appl. No. 16/833,496 dated May 12, 2020.

Non-Final Office Action for U.S. Appl. No. 17/733,922 dated Sep. 21, 2022.

Requirement for Restriction/Election for U.S. Appl. No. 17/559,522 mailed on Sep. 20, 2023.

(56) References Cited

OTHER PUBLICATIONS

Non-Final Office Action for U.S. Appl. No. 17/559,522 mailed on Dec. 19, 2023.
Non-Final Office Action for U.S. Appl. No. 18/360,678 mailed on Feb. 28, 2024.
Final Office Action for U.S. Appl. No. 17/559,522 mailed on Mar. 25, 2024.
First Search for Chinese Application No. 201911043619.X mailed on Feb. 1, 2024.

* cited by examiner (a) (b) (c)

FRACTURING DEVICE DRIVEN BY A VARIABLE-FREQUENCY ADJUSTABLE-SPEED INTEGRATED MACHINE AND A WELL SITE LAYOUT

CROSS-REFERENCE TO RELATED APPLICATIONS

This application is a continuation of International patent application No. PCT/CN2022/101889 filed Jun. 28, 2022, which claims the benefit of Chinese patent application No. 202111198446.6 filed before China National Intellectual Property Administration (CNIPA) on Oct. 14, 2021. The disclosure of all of the above-referenced applications are incorporated by reference in the entirety.

TECHNICAL FIELD

The invention relates to a field of oil/gas field fracturing, specifically, relates to a fracturing device driven by a variable-frequency adjustable-speed integrated machine (VFASIM) and a well site layout including a plurality of above fracturing devices.

BACKGROUND ART

In the global oil/gas field fracturing working site, a power transmission system adopted in a traditional fracturing device has a configuration in which a transmission device includes a gearbox and a transmission shaft, a diesel engine (which is a power source) is connected to the gearbox of the transmission device, and then a plunger pump (which is an actuating element) of the fracturing device is driven by the transmission shaft of the transmission device to operate. The disadvantages of the traditional fracturing device brought by the configuration of the above power transmission system are: (1) since the diesel engine needs to drive the plunger pump of the fracturing device through the gearbox and the transmission shaft, it results in a large volume, a large weight, a limited transportation and a small power density of the fracturing device; (2) since the diesel engine is used as the power source, the fracturing device produces engine exhaust pollution and noise pollution (for example, the noise exceeds 105 dBA) during the well site operation, which seriously affects the normal life of surrounding residents; (3) regarding the fracturing device driven by the diesel engine via the gearbox and the transmission shaft, the device has a relatively high cost for initial purchasing, the device has a relatively high cost in fuel consumption per unit power during operation, and a daily maintain cost for the engine and the gearbox is relatively high too. In view of the global oil/gas development device being developed towards the direction of "lower power consumption, lower noise and lower exhaust emission", the above disadvantages of the traditional fracturing device with the diesel engine as the power source greatly hinder the development process of the unconventional oil/gas energy.

In order to overcome the shortage of the above traditional fracturing device, some electric fracturing devices in which a motor is used to replace the diesel engine have been developed. In such electric fracturing devices, the power source is a motor, the transmission device is a transmission shaft (as necessary, a coupler or a clutch may be additionally provided), and the actuating element is a plunger pump. Since the motor is adopted to drive the plunger pump, the electric fracturing device has advantages of smaller volume, lighter weight as well as more economy, energy conservation, and environmental protection and the like.

However, in the existing electric fracturing device, a transducer (i.e., a frequency changer), for example shown in (b) of FIG. 1, is generally adopted to regulate voltage and speed so as to drive the motor. The transducer includes a power supply switch, a rectifying transformer and a functional member such as a rectifying section and an inverting section. The supply voltage of the existing grid is relatively high, an output voltage and an input voltage of the transducer are generally not matched, so the above rectifying transformer may be provided in the transducer so as to regulate voltage. The result is that the transducer has a larger volume and weight due to the need of containing the rectifying transformer, and thus the transducer is placed separately and independently from the motor. Hence, more external wirings are needed between the motor and the transducer, so the layout occupies a large area and the well site arrangement is relatively complex. Further, since each of transducers is independent to the motor, in actual applications of the existing electric fracturing device for example as shown in (a) of FIG. 1, for the sake of layout and transportation, it needs to use at least one transducer sleigh (the transducer sleigh (1), the transducer sleigh (2), . . . ), wherein at least one transducer is integrally installed on each transducer sleigh, and at least one existing electric fracturing device (the electric fracturing device (1), the electric fracturing device (2), the electric fracturing device (3), . . . ) is connected to the power supply system via one transducer sleigh. This layout with a need of using the transducer sleigh further causes expansion of the occupied area and complexity of the well site arrangement.

Since the existing electric fracturing device has a low integration degree and a large occupied area, there is no sufficient area to arrange various members of the existing electric fracturing device when the well site is constructed, or even though it is possible to arrange various members, expensive implementation cost is needed. Further, since different well sites have different well site conditions, there is no electric fracturing device which has a high degree of integration and conveniently adapts to various well site conditions.

SUMMARY

Technical Problem to be Solved

The purpose of the present disclosure is to provide an overall layout of the fracturing device with a high degree of integration, in which a VFASIM is used and is integrally installed together with the plunger pump of the fracturing device. The VFASIM itself has a high withstanding voltage performance which may be obtained from parameter adjustment, and thus it can be directly connected to the power supply system with a high voltage without additionally via a rectifying transformer for adjusting the voltage. Further, according to the overall layout of the present disclosure, such VFASIM is integrally installed together with the plunger pump of the fracturing device, so the overall layout of the fracturing device with a high degree of integration is obtained, and the obtained fracturing device has convenience and general applicability for most of well sites.

Technical Solution for Solving Problems

For achieving the above purpose, a fracturing device driven by a VFASIM according to one embodiment of the present disclosure includes a VFASIM and a plunger pump. The VFASIM includes: a driving device for providing a driving force; and an inverting device integrally installed on the driving device. The inverting device supplies power to the driving device. The plunger pump is integrally installed with the VFASIM, the plunger pump is mechanically connected to the driving device of the VFASIM and is driven by the driving device.

A well site layout according to one embodiment of the present disclosure includes: a plurality of the fracturing devices; and a control chamber. In the control chamber, a centralized control system is provided, and the centralized control system is used for integrally controlling each of the plurality of fracturing devices. Further or alternatively, an electric power supplied from the power supply system is integrally supplied to each of the plurality of fracturing devices via the control chamber.

Advantageous Effects

The VFASIM adopted in the overall layout of the fracturing device of the present disclosure has no need to be additionally equipped with a rectifying transformer for adjusting the voltage, and thus has a small volume and a light weight. According to the overall layout of the present disclosure, it is possible to integrally install such VFASIM and the plunger pump of the fracturing device on one sleigh such that the occupied area of the device can be reduced and the well site facility arrangement can be optimized, and the obtained overall layout has a high degree of integration, and are more convenient, economical, and environmental.

DETAILED DESCRIPTION

Figure 1:
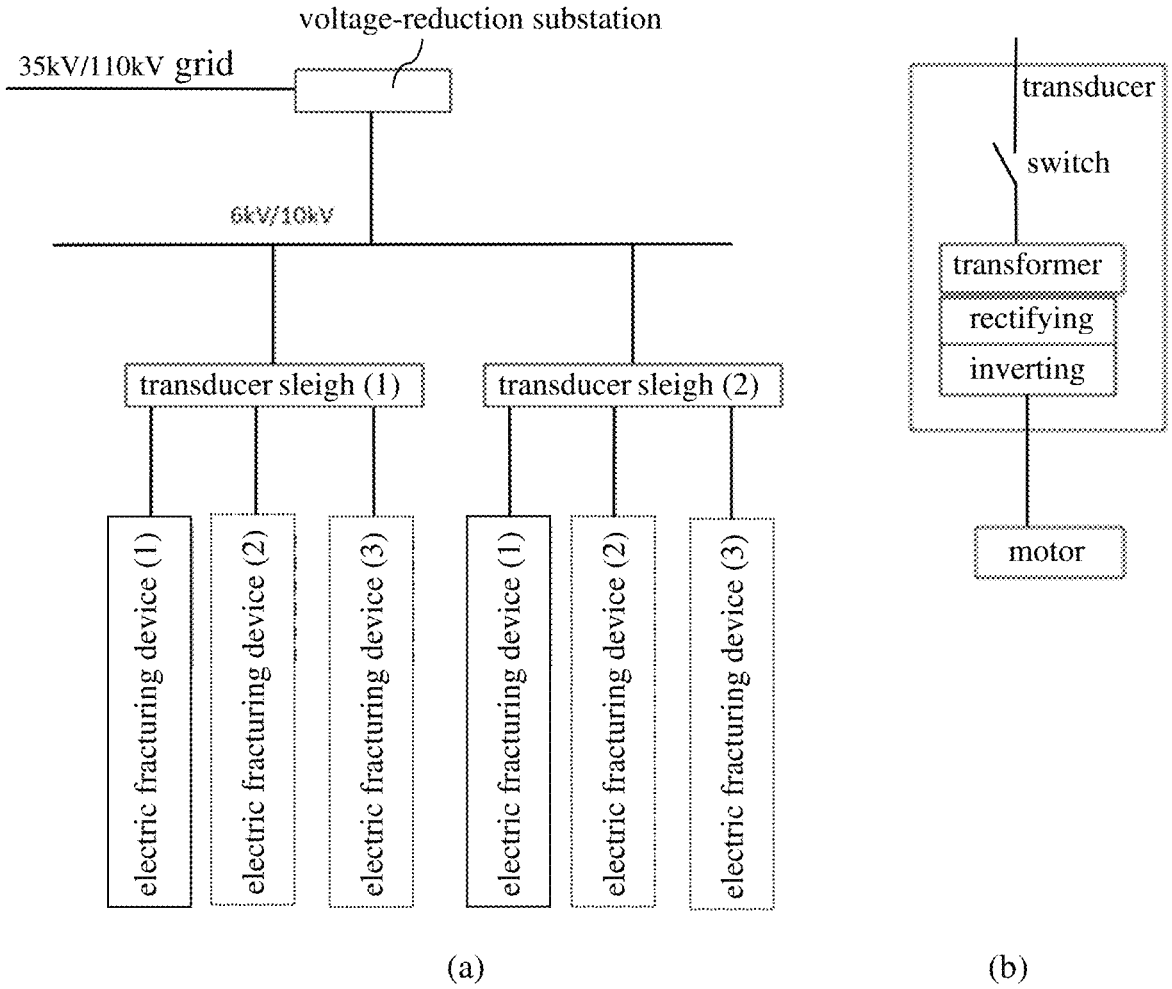
FIG. 1 shows a configuration of a transducer, a motor with its voltage and frequency regulated by the transducer, and a connection mode between an existing electric fracturing device including the motor and a power supply system according to the prior art.
Figure 2A:
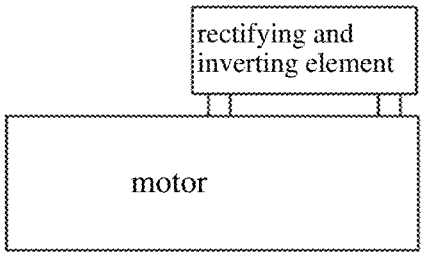
FIGS. 2A to 2D each is a schematic diagram of a VFASIM according to a first embodiment of the present disclosure.
Figure 2B:
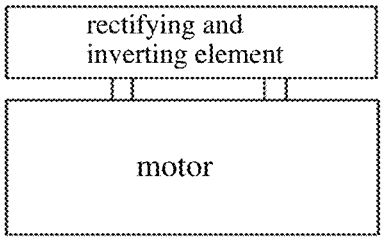
Figure 2C:
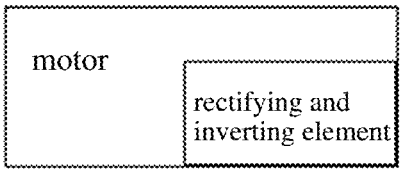
Figure 2D:
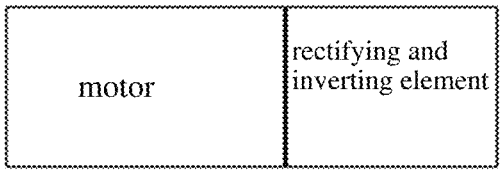

Embodiments of the present disclosure are described in detail below with reference to the drawings. The following description relates to some specific embodiments of the present disclosure, but the present disclosure is not limited to this. In addition, the present disclosure is not limited to the arrangement, dimension, dimension ratio or the like of each component shown in each of drawings, either. It should be noted that the description is given in the following order.

<1. VFASIM>
<2. Fracturing device driven by a VFASIM>
  2.1 structure of the fracturing device
    2.1.1 overall layout
    2.1.2 lubrication system
    2.1.3 cooling system
    2.1.4 power supply and control system
    2.1.5 sleigh frame for integration
  2.2 operating and effect of the fracturing device
<3. Connection between the VFASIM and the plunger pump and driving mode therebetween>
  3.1 example in which a single pump is driven by a single motor
  3.2 example in which multiple pumps are driven by a single motor
  3.3 example in which the motor is replaced by a turbine
<4. Well site layout for the fracturing device>
<5. Other modification examples>

Various embodiments and examples of the present disclosure would be described in detail below.

1. VFASIM

FIGS. 2A to 2D each is a schematic diagram of a VFASIM according to a first embodiment of the present disclosure. As shown in FIGS. 2A to 2D, the VFASIM according to the first embodiment of the present disclosure includes a motor and a rectifying inverting element integrally installed on the motor.

The motor (which is an electrical motor) refers to an electromagnetic device that enables conversion or transmission of electric energy in accordance with the electromagnetic induction law. The motor mainly plays a role of generating a driving torque such that it may be used as a power source of a well site facility. The motor may be an AC (alternating current) type of motor. In one example, a bottom surface of the motor may be disposed on one base (for example, a supporting frame). When the VFASIM is arranged in a working site, the above base (for example, the supporting frame) is in contact with the ground, so the stability of the VFASIM is enhanced.

The rectifying inverting element is electrically connected to the motor through a power supply wiring. In general, when the rectifying inverting element performs a frequency conversion on an alternating current (AC) from a power supply system, the AC is firstly converted into a direct current (DC) (this process is also referred to "rectifying"), the DC is then converted into AC with a variable frequency (this process is also referred to "inverting"), which is supplied to the motor.

The motor adopted in the present disclosure can have a withstanding voltage performance by adjusting its parameters to be adaptive to the power supply system, such that there is no need to additionally use a rectifying transformer to regulate the voltage, it is sufficient to use a rectifying inverting element to perform a frequency and/or voltage adjustment. Since such rectifying inverting element has a much smaller volume and weight than the transducer including the rectifying transformer, the rectifying inverting element can be directly integrated on the motor. The rectifying inverting element and the motor may each have a housing (an example of a motor 10 and a housing 12 for containing the motor 10 will be described in detail later with reference to FIG. 9, etc.). A first housing of the rectifying inverting element is integrally (compactly) installed on a bottom surface (if the bottom surface does not fully contact with the supporting frame or the base), any side surface (e.g., any one of two side surfaces in a direction perpendicular to the extension direction of a transmission output shaft of the motor) or a top surface of a second housing of the motor. Thus, an output wiring of the rectifying inverting element can be directly joined into the interior of the motor, so it is possible to effectively shorten the wiring. Since wirings of the rectifying inverting element and the motor are located inside the second housing of the motor, it is possible to reduce interference in the well site. In some embodiments, the first housing of the rectifying inverting element is installed on the top surface of the second housing of the motor, so the top surface of the second housing can function to fix and support the rectifying inverting element and the rectifying inverting element does not separately occupy an installation area. Such an arrangement greatly saves the installation space so as to make the whole device more compact.

In some examples, shapes of the first housing of the rectifying inverting element and the second housing of the motor may be a column-like object such as a cuboid, a cube, or a cylinder, although the examples of the present disclosure are not specifically limited to this. When shapes of the first housing and the second housing are a cuboid or a cube, it is beneficial to fixedly install the first housing of the rectifying inverting element on the second housing of the motor, so as to enhance the stability of the whole device. The first housing may be directly connected to the second housing in the manner of bolts, screws, riveting, welding, etc., or may be fixedly connected to the second housing via a mounting flange. The connection surfaces of the first housing and the second housing may be provided with a plurality of holes or a plurality of wiring columns through which the wirings can penetrate, the wirings may include a power supply wiring for electrically connecting the rectifying inverting element to the motor such that AC after a frequency and/or voltage adjustment by the rectifying inverting element is directly output to the motor and the motor is driven to operate in an adjustable rotational speed.

The example of the present disclosure does not specifically limit the connection position and connection mode between the rectifying inverting element (or the housing thereof) and the motor (or the housing thereof), it is sufficient to integrally and fixedly install the rectifying inverting element and the motor together.

The rectifying inverting element and the motor are integrated in the VFASIM of the example of the present disclosure and it does not include a rectifying transformer. Therefore, it is possible to provide only a rectifying inverting element on the motor, so the whole volume and weight of the VFASIM are reduced.

2. Fracturing Device Driven by a VFASIM

2.1 Structure of the Fracturing Device

2.1.1 Overall Layout

Figure 3:
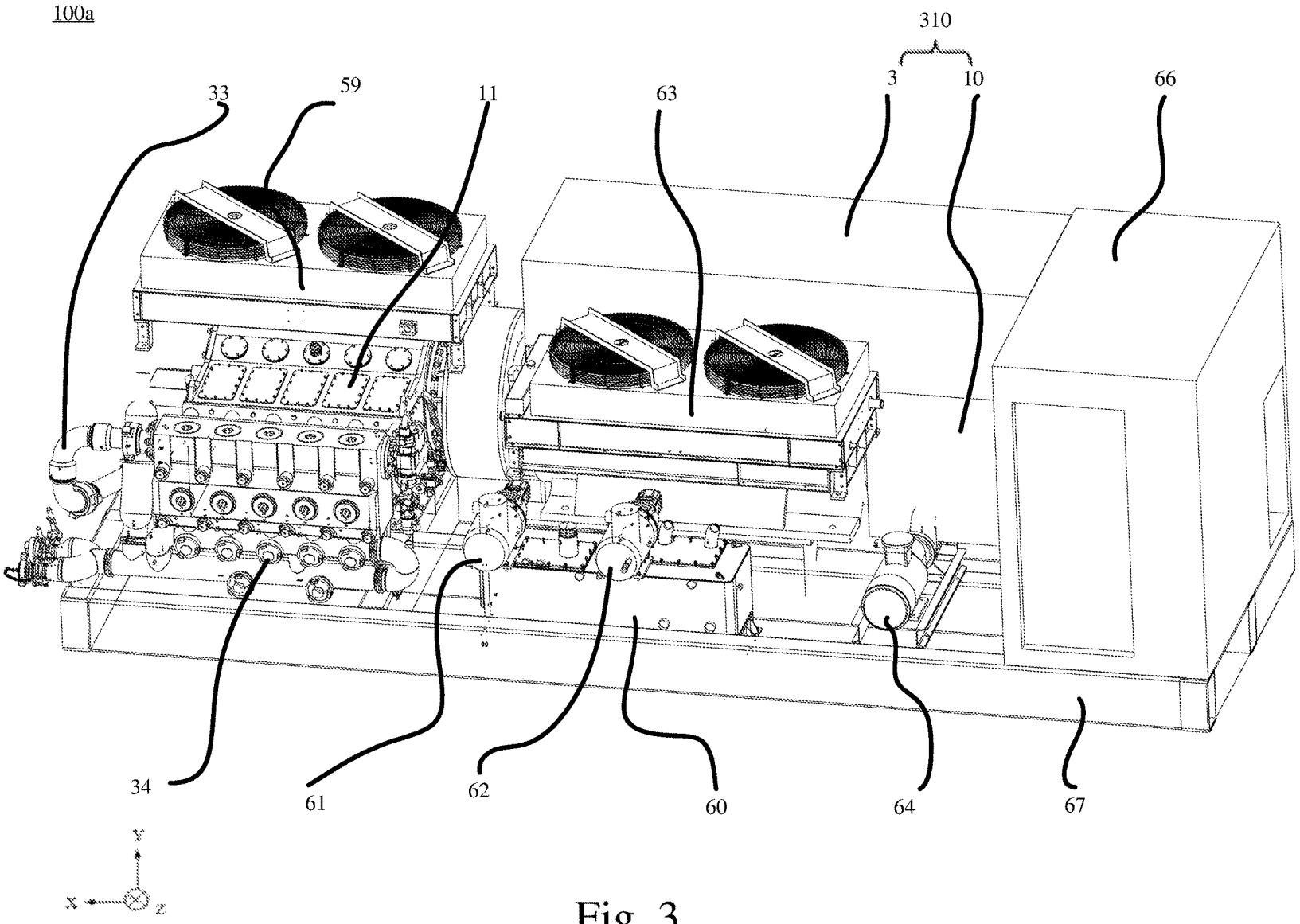
FIG. 3 is a perspective diagram of an overall layout of a fracturing device including the VFASIM and driven by the VFASIM according to a second embodiment of the present disclosure.
Figure 4A:
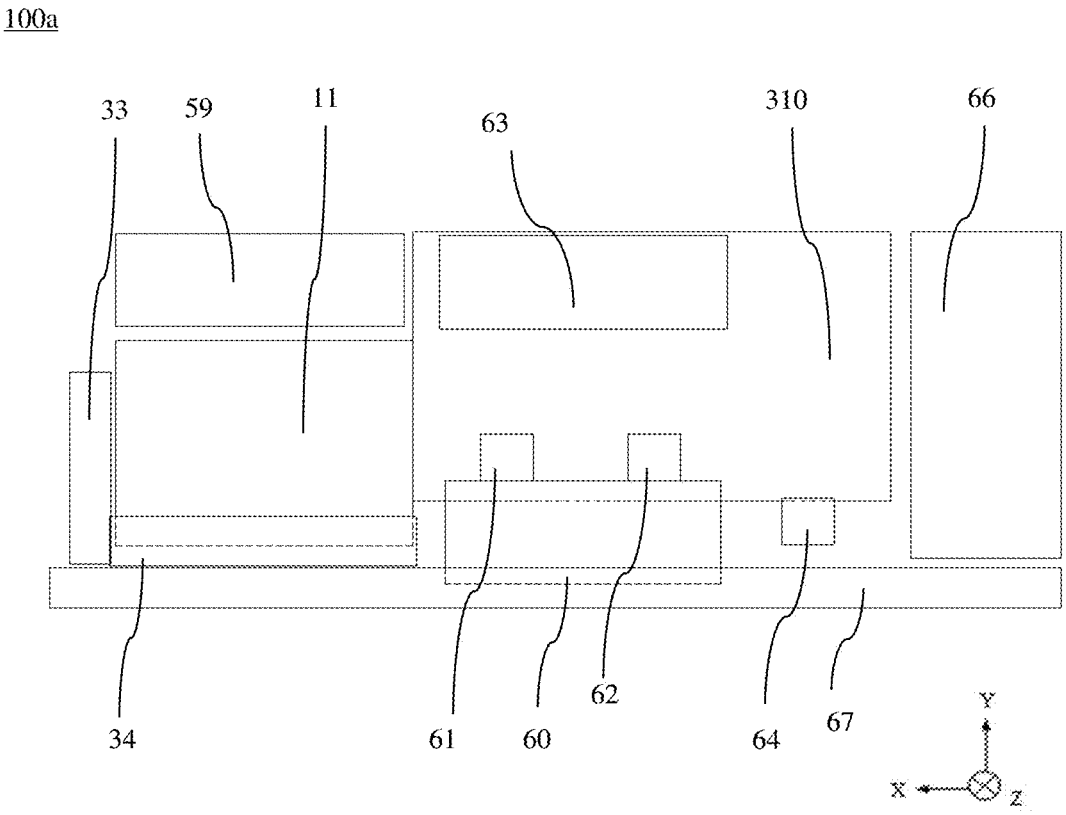
FIGS. 4A and 4B schematically show a side view and a top view of the overall layout of the fracturing device shown in FIG. 3, respectively.
Figure 4B:
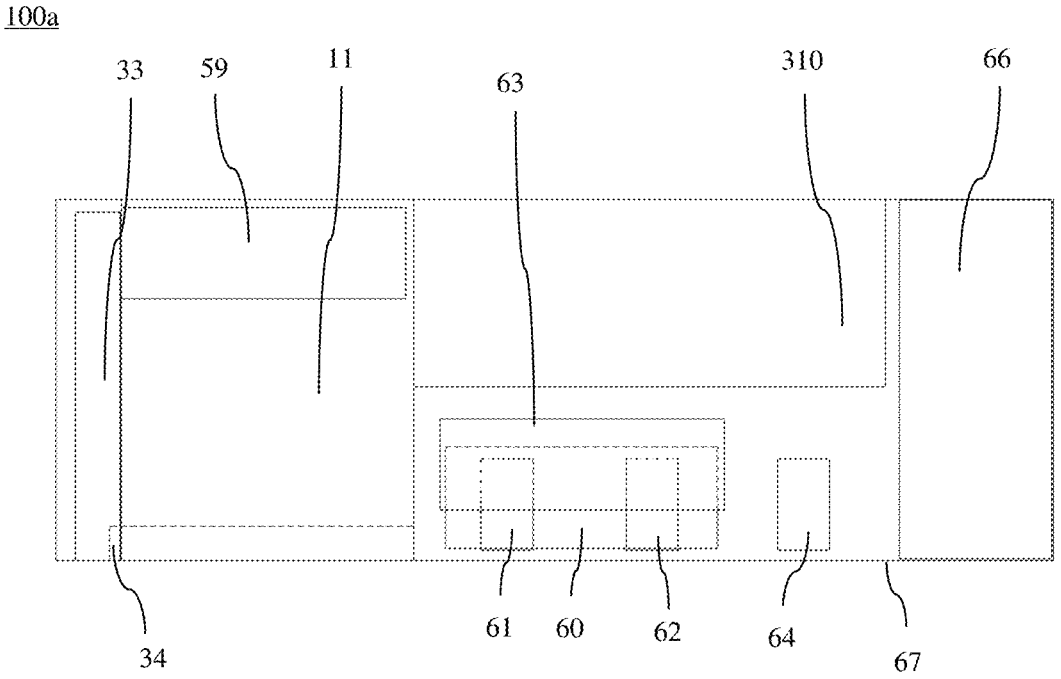

FIG. 3 is a perspective diagram of an overall layout of a fracturing device including the VFASIM and driven by the VFASIM according to a second embodiment of the present disclosure. FIGS. 4A and 4B schematically show a side view and a top view of the overall layout of the fracturing device shown in FIG. 3, respectively.

As shown in FIG. 3 and FIGS. 4A and 4B, a fracturing device 100*a* includes: a supporting frame 67; a VFASIM 310 installed on the supporting frame 67; and a plunger pump 11 installed on the supporting frame 67 and integrally connected to the VFASIM 310. The VFASIM 310 includes a motor 10 and a rectifying inverting element 3 integrally installed on the motor 10. The transmission output shaft of the motor 10 in the VFASIM 310 may be directly connected to the transmission input shaft of the plunger pump 11 of the fracturing device 100*a*. These two shafts may be connected through splines. For example, the transmission output shaft of the motor 10 may have an internal spline, an external spline, a flat key or a conical key, the transmission input shaft of the plunger pump 11 may have an external spline an internal spline, a flat key or a conical key that fits to the above keys. The transmission output shaft of the motor 10 may have a housing for protection, the transmission input shaft of the plunger pump 11 may have a housing for protection, and these two housings may be fixedly connected together by using bolts, screws, riveting, welding, a flange, etc. The flange may be of a shape in round or square or in other manner.

In FIGS. 3 and 4A, it is assumed that the horizontally and outwardly extending direction of the transmission output shaft of the motor 10 (the direction towards the plunger pump 11 from the VFASIM 310) is X direction, the upward direction perpendicular to the X direction is Y direction, and the direction orthogonal to both the X direction and the Y direction and inwardly extending perpendicular to the sheet of FIG. 4A is Z direction.

The fracturing device 100*a* may also include a control cabinet 66. The control cabinet 66 is disposed at one end of the VFASIM 310 in −X direction, and the plunger pump 11 of the fracturing device 100*a* is disposed at another end of the VFASIM 310 in the X direction. The present disclosure does not limit the positions of the control cabinet 66, the VFASIM 310 and the plunger pump 11 relative to each other, and it is sufficient that their layout can make the fracturing device 100*a* be highly integrated. The electric power transferred from the power grid and the like may be directly supplied to the VFASIM, or may be supplied to the VFASIM via the control cabinet (without processed by the control cabinet or after having been processed by the control cabinet). For example, the control cabinet 66 may control the fracturing device 100*a* and may supply power to any electric element in the fracturing device 100*a*. For example, a high voltage switching cabinet and an auxiliary transformer may be integrally provided in the control cabinet 66. The auxiliary transformer in the control cabinet 66 may perform a voltage adjustment on the electric power transported from the power grid and the like and then supply it to various electric elements in the fracturing device. Alternatively, the auxiliary transformer in the control cabinet 66 may perform a voltage adjustment on the electric power transported from the power grid and the like and then supply it to auxiliary electric elements in the fracturing device except the VFASIM. As one example, the auxiliary transformer can output a low voltage of 300V~500V (AC) so as to supply power to auxiliary electric elements such as a lubrication system, a cooling system and the like in the fracturing device 100*a*.

The auxiliary electric element in the fracturing device 100*a* for example includes a motor for a lubrication system, a motor for a cooling system, a control system and the like.

As described in the aforementioned example, the VFASIM 310 doesn't need to use a rectifying transformer. The rated frequency of the VFASIM 310 may be 50 Hz or 60 Hz, this rated frequency is the same as a frequency of a power supply from the power supply system such as a power grid. Therefore, the VFASIM 310 can be directly connected to the power supply system such as a power grid, which makes the power supply mode simpler and enhances the adaptiveness.

Since the whole fracturing device 100*a* doesn't need a rectifying transformer for adjusting the voltage due to usage of the VFASIM 310, the external wiring of the fracturing device 100*a* can be directly connected to a high voltage power supply system. The plunger pump 11 of the fracturing device 100*a* is driven by the VFASIM 310 so as to pump a fracturing liquid to the underground.

A low-pressure manifold 34 may be provided at one side of the plunger pump 11 in the −Z direction, for supplying the fracturing liquid to the plunger pump 11. A high-pressure manifold 33 may be provided at one end of the plunger pump 11 in the X direction, for discharging the fracturing liquid. The fracturing liquid enters to the interior of the plunger pump 11 through the low-pressure manifold 34, is pressurized by the movement of the plunger pump 11, and then is discharged to a high pressure pipeline outside the plunger pump 11 through the high-pressure manifold 33.

The fracturing device 100*a* may also include: a lubrication system; a lubrication oil cooling system; and a coolant cooling system, etc. For example, the lubrication system includes: a lubrication oil tank 60; a first group of lubrication motor and lubrication pump 61; and a second group of lubrication motor and lubrication pump 62, etc. The lubrication oil cooling system for example includes a lubrication oil radiator 59, etc. The coolant cooling system for example includes: a coolant radiator 63; and a group of water motor and water pump 64, etc.

Figure 5A:
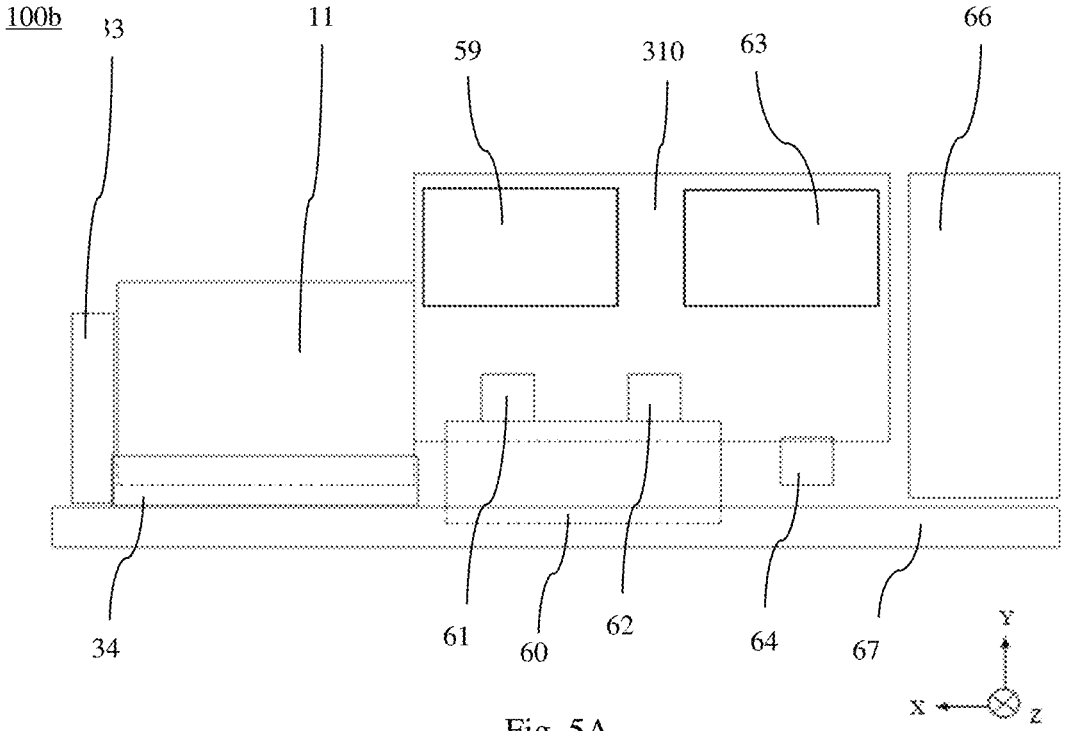
FIGS. 5A and 5B schematically show a side view and a top view according to a modification example of FIGS. 4A and 4B, respectively.
Figure 5B:
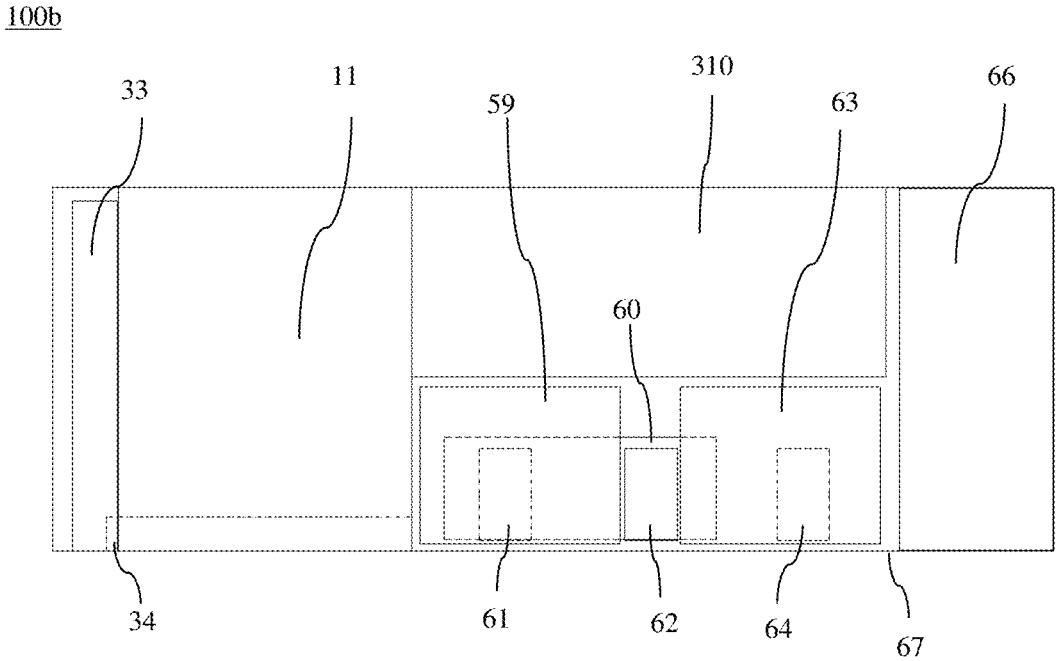

FIGS. 5A and 5B schematically show a side view and a top view according to a modification example of FIGS. 4A and 4B, respectively. The fracturing device 100*b* in FIGS. 5A and 5B is different from the fracturing device 100*a* in FIGS. 4A and 4B in that: from the view of the top view, in FIG. 4B, the lubrication oil radiator 59 is placed at a side of the plunger pump 11 in the Z direction and the coolant radiator 63 is placed at a side of the VFASIM 310 in the −Z direction, while in FIG. 5B, the lubrication oil cooling device 59 and the coolant radiator 63 are placed substantively side by side at a side of the VFASIM 310 in the −Z direction. Other aspects of the fracturing device 100*b* are the same as the fracturing device 100*a*, and the repeated description is omitted here. Both the fracturing device 100*a* and the fracturing device 100*b* are referred to the fracturing device 100 when there is no need to distinguish them from each other.

Further, the lubrication system, the lubrication oil cooling system and the coolant cooling system as above described may be disposed at any suitable positions on the supporting frame, for example, at the top or side surface(s) of the plunger pump 11 or at the top or side surface(s) of the VFASIM 310. It is sufficient that such positions can make the overall layout have a high degree of integration. In addition, the above lubrication oil cooling system is used for providing a function of cooling the lubrication oil. The above coolant cooling system is used for providing a function of cooling the plunger pump 11 and/or the VFASIM 310. The above lubrication oil cooling system and the coolant cooling system may be at least partly replaced by an air cooling system as necessary. Further, the above lubrication oil radiator and coolant radiator may be the horizontal radiator, vertical radiator or tetragonal radiator as shown in FIGS. 6A to 8, and the air flow path and the coolant or lubrication oil flow path therein are not limited to examples shown in the drawings, but may be adaptively changed or set according to actual requirements. Later, the specific example would be described for the cooling system of the VFASIM 310 with reference to FIGS. 9 to 16.

2.1.2 Lubrication System

As described above, the lubrication system of the fracturing device 100 for example includes: a lubrication oil tank 60; a first group of lubrication motor and lubrication pump 61; and a second group of lubrication motor and lubrication pump 62. The lubrication system may be divided into a high pressure lubrication system and a low pressure lubrication system, the high pressure lubrication system is used to provide lubrication for the power end of the plunger pump, and the low pressure lubrication system is used to provide lubrication for a gearbox or the like. The first group of lubrication motor and lubrication pump 61 and the second group of lubrication motor and lubrication pump 62 may be each used in the high pressure lubrication system and the low pressure lubrication system. The lubrication oil tank 60 may be placed on the supporting frame 67, for example at any side of the VFASIM 310 or at other positions in favor of the device layout having integration. The lubrication oil for the high pressure lubrication system and/or the low pressure lubrication system is stored in the lubrication oil tank 60.

2.1.3 Cooling System

As described above, the cooling system of the fracturing device 100 for example includes a lubrication oil cooling system for reducing the temperature of the lubrication oil at the power end of the plunger pump, so as to ensure a temperature for normal operating of the plunger pump 11 during an operating process. The lubrication oil cooling system may include a lubrication oil radiator, a cooling fan, and a cooling motor, wherein the cooling fan is driven by the cooling motor. For example, the lubrication oil cooling system may be placed at the top or side surface(s) of the plunger pump 11, or at the top or side surface(s) of the VFASIM 310. During the process of performing the lubrication oil cooling, after the lubrication oil enters the interior of the lubrication oil radiator, air flows under the driving due to the blade's rotation of a radiator fan, the air exchanges heat with the lubrication oil inside the lubrication oil radiator, thereby reducing the temperature of the lubrication oil, and the lubrication oil with a reduced temperature enters the interior of the plunger pump 11, thereby reducing a temperature of the power end of the plunger pump.

As described above, the cooling system of the fracturing device 100 further includes for example a coolant cooling system. The VFASIM 310 generates heat during operating. In order to prevent the device from being damaged by the heat during a long period of operation, the coolant cooling may be adopted. The coolant cooling system has a coolant radiator and a radiator fan, and further has driving elements such as a motor and a pump for pumping the coolant. The coolant cooling system can also be replaced by an air cooling mode in which a cooling fan needs to be used.

For example, the coolant cooling system may be placed at the top or side surface(s) of the plunger pump 11 or the top or side surface(s) of the VFASIM 310. For example, when the VFASIM 310 is cooled, a coolant medium (which may be antifreeze or oil or water, etc.) is cycled inside the VFASIM 310 and inside the coolant radiator 63 by a group of water motor and the water pump (wherein the water motor drives the water pump, and the water pump may be a vane pump such as a centrifugal pump, an axial flow pump, or a multi-stage pump, etc.). After the coolant medium enters the interior of the coolant radiator 63, air flows under the driving due to the blade's rotation of a radiator fan, the air exchanges heat with the coolant medium inside the coolant radiator, thereby reducing the temperature of the coolant medium, and the coolant medium with a reduced temperature enters the interior of the VFASIM 310 and performs a heat exchange with the VFASIM 310, thereby reducing the temperature of the VFASIM 310 and ensuring a temperature for normal operating of the VFASIM 310.

Figure 6A:
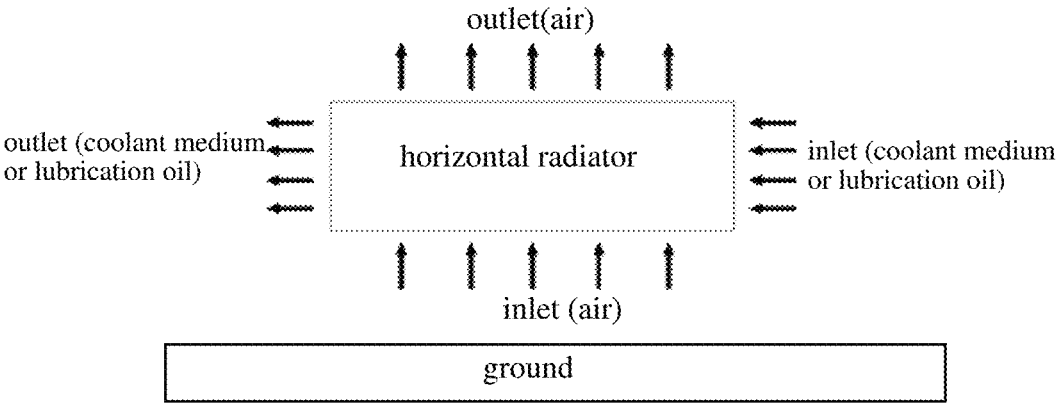
FIGS. 6A and 6B each shows an operating schematic diagram of examples of a horizontal radiator.
Figure 6B:
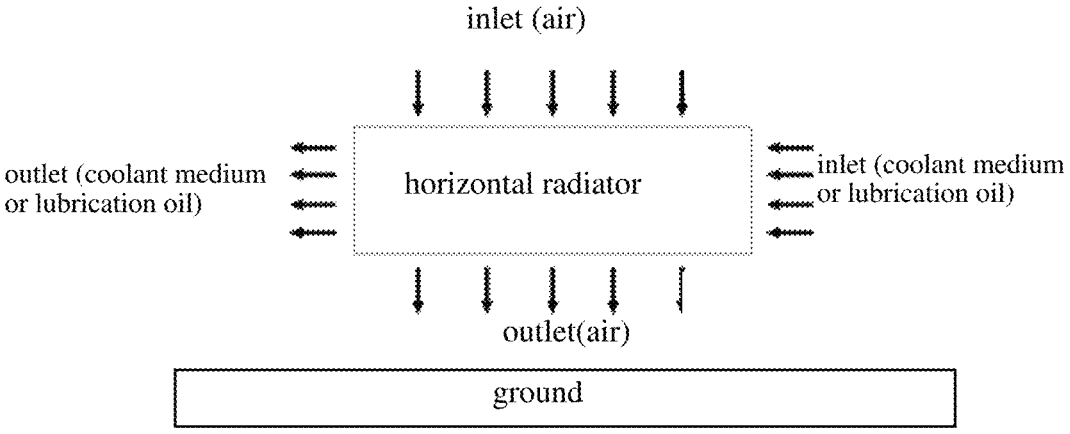
Figure 7A:
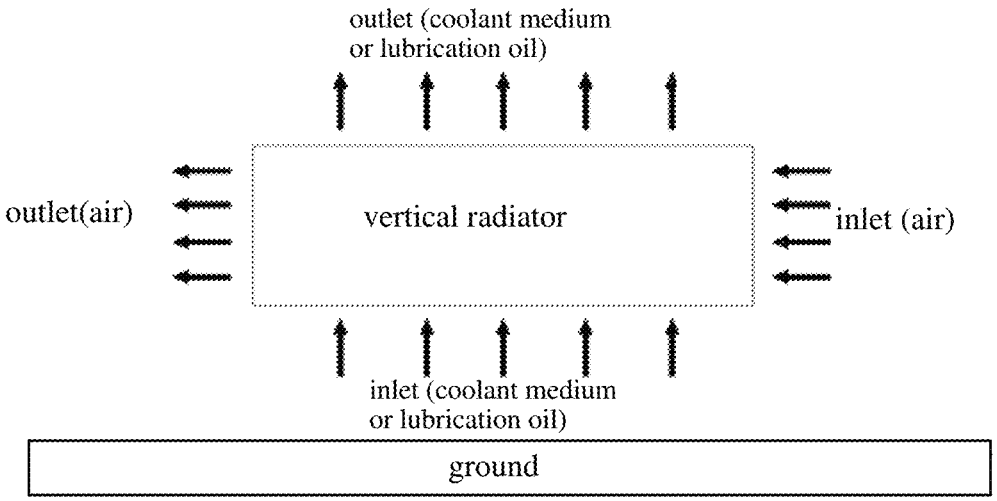
FIGS. 7A and 7B each shows an operating schematic diagram of examples of a vertical radiator.
Figure 7B:
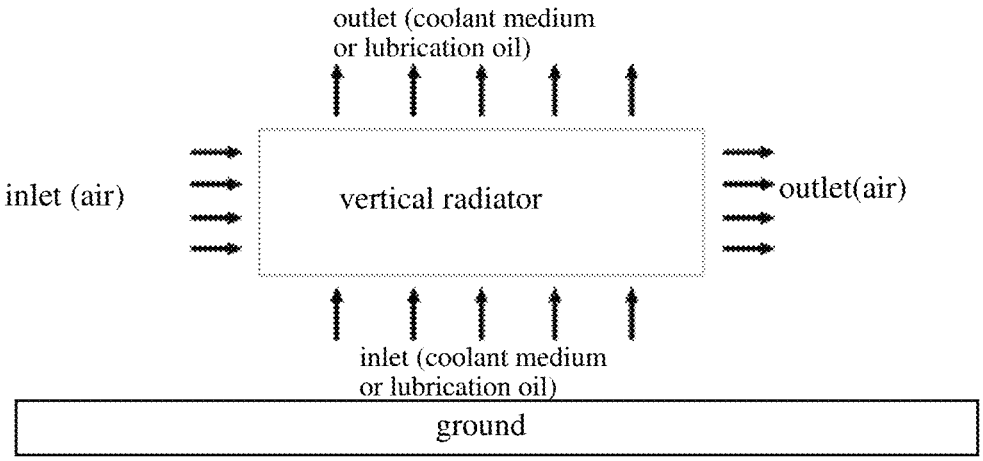
Figure 8:
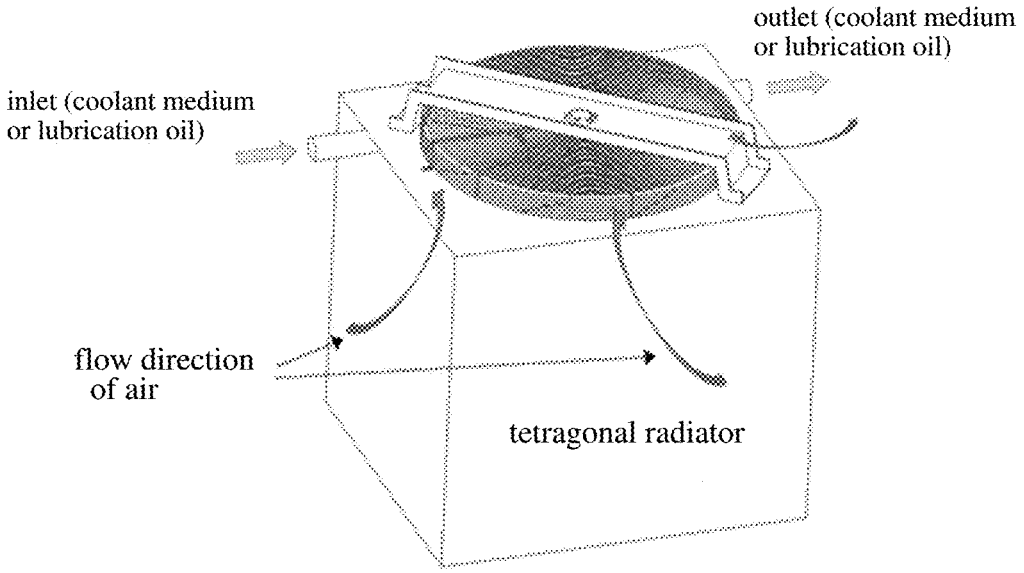
FIG. 8 shows an operating schematic diagram of an example of a tetragonal radiator.

FIGS. 6A and 6B each shows a schematic diagram of an example of a horizontal radiator during operation, and the shape of the horizontal radiator as well as its flow paths of air and coolant medium (such as water or oil, etc.) are not limited to examples shown in the drawings. FIGS. 7A and 7B each shows a schematic diagram of an example of a vertical radiator during operation, and the shape of the vertical radiator as well as its flow paths of air and coolant medium (such as water or oil, etc.) are not limited to examples shown in the drawings. FIG. 8 shows a schematic diagram of an example of a tetragonal radiator during operation. For the tetragonal radiator, a flow direction of air is, for example: air enters into the tetragonal radiator through at least one vertical side surface (e.g., four side surfaces) from outside, and then is discharged out through the top of the tetragonal radiator. For example, an inlet and an outlet of a cooling pipe for circulating the coolant or the lubrication oil may be provided on an upper portion (near the top) of the tetragonal radiator. The present disclosure is not limited to this example. The coolant radiator and the lubrication oil radiator of the present disclosure as above may be the horizontal radiator, the vertical radiator, or the tetragonal radiator.

The specific arrangement example of the VFASIM 310 and a cooling system for cooling the VFASIM 310 is described below.

Figure 9:
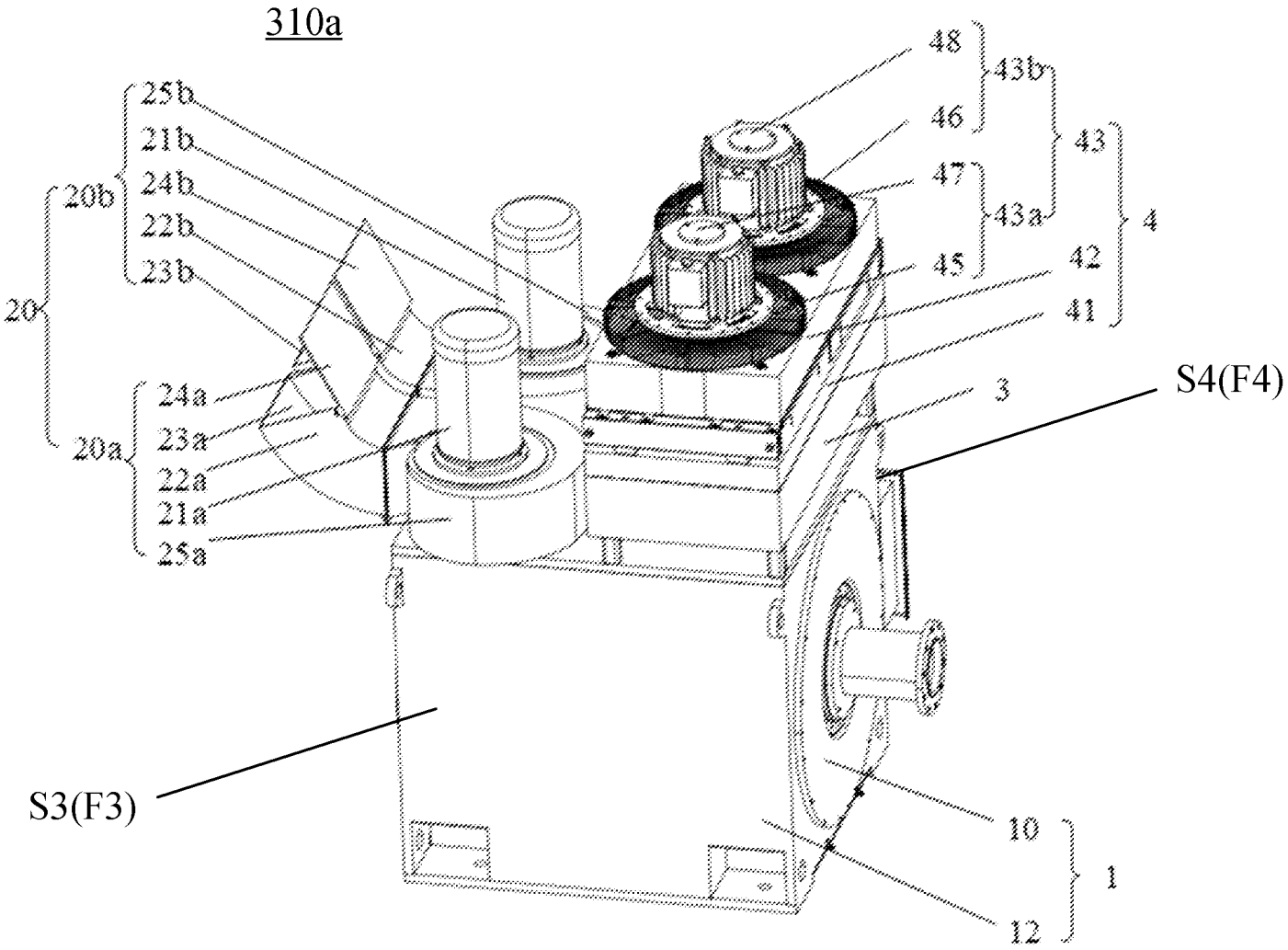
FIG. 9 is a perspective schematic diagram of the VFASIM and its cooling system according to one example of the first embodiment of the present disclosure.
Figure 10:
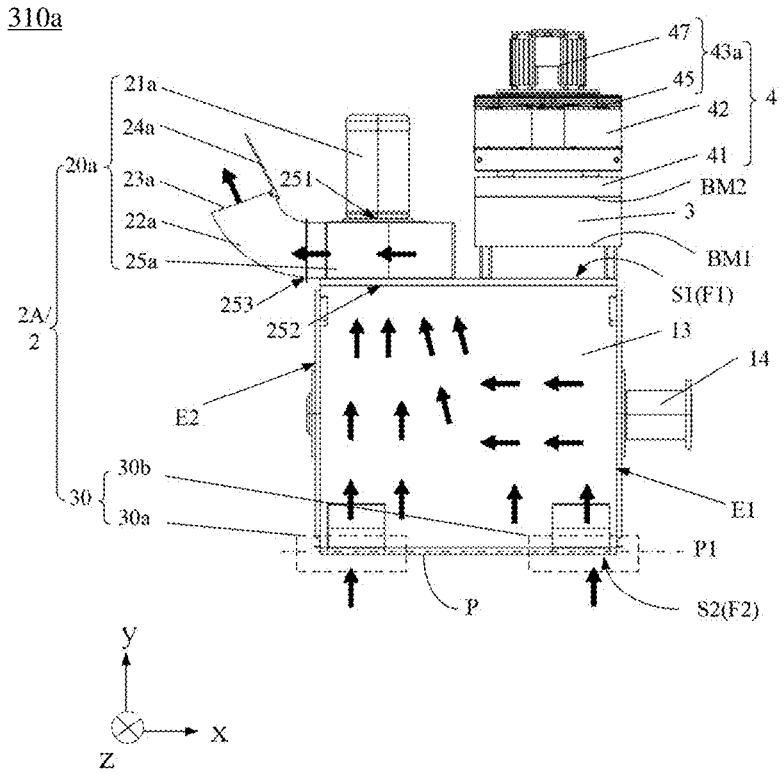
FIG. 10 is a schematic diagram of structure of the VFASIM and its cooling system shown in FIG. 9.

FIG. 9 is a perspective schematic diagram of the VFASIM and its cooling system according to one example of the first embodiment of the present disclosure. FIG. 10 is a schematic diagram of structure of the VFASIM and its cooling system shown in FIG. 9.

As shown in FIGS. 9 to 10, the VFASIM 310*a* provided in the example includes a driving device 1, a motor cooling device 2 (in this example, only an air cooling mechanism 2A is included), a rectifying inverting element 3 and a rectifying inverting element cooling device 4. The driving device 1 includes a motor 10 and a housing 12 for containing the motor 10. The housing 12 defines a cavity 13 for containing the motor 10. A transmission output shaft 14 of the driving device 1 protrudes from an end cover of the housing 12, and extends along a first direction (e.g., the x direction shown in FIG. 10). The housing 12 includes a first side S1 (the upper side shown in FIG. 10) and a second side S2 (the lower side shown in FIG. 10) opposite to each other in a second direction (e.g., the y direction shown in FIG. 10) perpendicular to the x direction. The housing 12 has a top surface F1 and a bottom surface F2 corresponding to the upper side and the lower side, respectively. The housing 12 also includes a third side S3 and a fourth side S4 opposite to each other in a third direction (e.g., the z direction shown in FIG. 10). Accordingly, the housing 12 has two side surfaces F3 and F4 corresponding to the third side S3 and the fourth side S4, respectively. The housing 12 further includes a first end E1 and a second end E2 opposite to each other in the x direction.

As shown in FIGS. 9 and 10, the rectifying inverting element cooling device 4 is provided on one side of the rectifying inverting element 3 away from the housing 12. That is, the rectifying inverting element 3 and the rectifying inverting element cooling device 4 are provided on the same side of the housing 12, and the rectifying inverting element 3 is located between the housing 12 and the rectifying inverting element cooling device 4. If the rectifying inverting element 3 and the rectifying inverting element cooling device 4 are provided on different sides of the housing 12, the rectifying inverting element 3 and the rectifying inverting element cooling device 4 are located on different surfaces of the housing 12, such an arrangement will increase the whole volume of the VFASIM 310*a*. In addition, since the rectifying inverting element cooling device 4 uses a coolant cooling mode to cool the rectifying inverting element 3, when they are located on different surfaces of the housing 12, the length of a cooling pipe for supplying the coolant needs to be longer, which affects the cooling effect of the rectifying inverting element cooling device 4 for the rectifying inverting element 3. In the VFASIM 310*a* according to one example of the present disclosure, by providing the rectifying inverting element 3 and the rectifying inverting element cooling device 4 on the same side of the housing 12, not only the structure of the VFASIM is more compact, but also the cooling effect of the rectifying inverting element cooling device 4 for the rectifying inverting element 3 is ensured.

The rectifying inverting element cooling device 4 includes a cooling plate 41 (for example, also referred to a water cooling plate when water is used as a coolant medium), a coolant storage assembly 42 and a fan assembly 43. The fan assembly 43 has a first fan assembly 43*a* and a second fan assembly 43*b*. The first fan assembly 43*a* includes a cooling fan 45 and a cooling motor 47, the second fan assembly 43*b* includes a cooling fan 46 and a cooling motor 48. The two fan assemblies 43*a* and 43*b* can simultaneously cool the coolant in a coolant storage chamber 52 in the coolant storage assembly 42 so as to reduce the temperature of the coolant, thus the cooling effect is enhanced. In addition, the air cooling mechanism 2A includes an air-in assembly 30 and an air-out assembly 20. The air-in assembly 30 is located at the bottom surface of the housing 12, and includes a first air-in assembly 30*a* and a second air-in assembly 30*b*. Protective screens P at least covering the first air-in assembly 30*a* and the second air-in assembly 30*b* respectively are provided at the bottom surface of the housing 12, so as to prevent outside foreign things from being sucked into the cavity 13. The air-out assembly 20 includes a first air-out assembly 20*a* and a second air-out assembly 20*b*. The first air-out assembly 20*a* includes: a cooling fan 21*a*, an air-discharging duct 22*a* and a fan volute 25*a*. The air-discharging duct 22*a* is provided with an air-out port 23*a* and a cover plate 24*a* for the air-out port. The fan volute 25*a* has a first side 251 communicating with the cooling fan 21*a*, a second side 252 communicating with the cavity 13 of the housing 12, and a third side 253 communicating with the air-discharging duct 22*a*. The second air-out assembly 20*b* has a configuration similar to the first air-out assembly 20*a*. The rectifying inverting element 3 includes a first surface BM1 close to the housing 12 and a second surface BM2 away from the housing 12. That is, the first surface BM1 and the second surface BM2 are opposite to each other in a direction (for example, the y direction shown in the drawing) perpendicular to the transmission output shaft 14. The cooling plate 41 is located on the second surface BM2 and directly contacts the second surface BM2.

Figure 11:
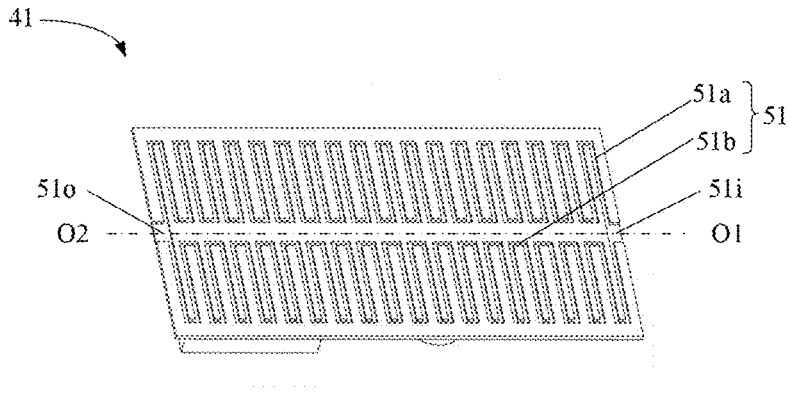
FIG. 11 is a schematic diagram of structure of a cooling plate in the cooling system shown in FIG. 9.

FIG. 11 is a schematic diagram of structure of a cooling plate 41 in the cooling system shown in FIG. 9. For example, as shown in FIG. 11, the cooling plate 41 for example includes a cooling channel. The cooling channel includes at least one cooling pipe 51 (51*a* and 51*b*), a cooling channel inlet 51*i* and a cooling channel outlet 51*o*. When the coolant flows in the at least one cooling pipe of the cooling plate 41, heat exchange with the rectifying inverting element 3 located below the cooling plate 41 can be performed, so as to achieve the purpose of cooling the rectifying inverting element 3. In order to enhance the cooling effect, the cooling plate 41 and the rectifying inverting element 3 directly contact with each other. In one example, the coolant includes water or oil and the like. In the embodiment of the present disclosure, since the cooling pipes 51*a* and 51*b* share one cooling channel inlet 51*i* and one cooling channel outlet 51*o*, not only the heat exchange area of the cooling plate is increased and the cooling effect is enhanced, but also the process of manufacturing the cooling plate can be simplified and the manufacturing cost can be reduced. In some examples, the arrangement manner in which the cooling pipe 51*a* and the cooling pipe 51*b* run has an S-like shape, a jagged shape, a straight line shape or the like, and the present disclosure is not limited hereto.

Figure 12:
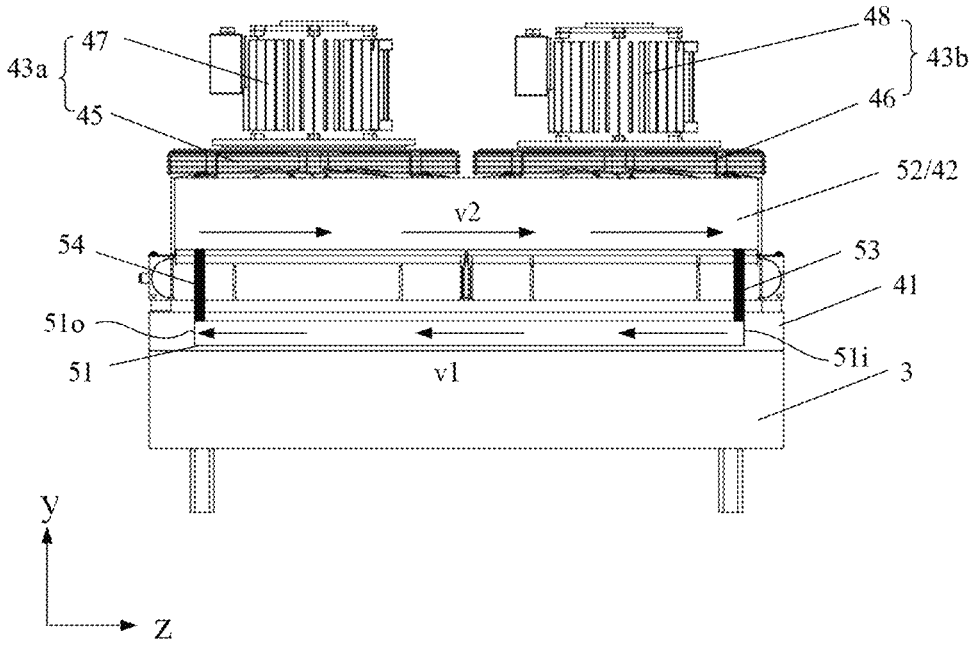
FIG. 12 is a schematic diagram of structure of a rectifying inverting element and a rectifying inverting element cooling device shown in FIG. 10.

FIG. 12 is a schematic diagram of structure of a rectifying inverting element and a rectifying inverting element cooling device shown in FIG. 10. For example, as shown in FIG. 12, the coolant storage assembly 42 is provided at a side of the cooling plate 41 away from the rectifying inverting element 3, and includes the coolant storage chamber 52 communicating with the cooling plate 41 so as to store the coolant and supply the coolant to the cooling plate 41. The right end of the coolant storage chamber 52 is connected to the cooling channel inlet 51*i* through a first connection pipe 53, and the left end of the coolant storage chamber 52 is connected to the cooling channel outlet 51*o* through a second connection pipe 54. In the example, the coolant flows into the cooling plate 41 from the coolant storage chamber 52 through the first connection pipe 53, and flows back to the coolant storage chamber 52 from the cooling plate 41 along a first movement direction v1 through the second connection pipe 54, and then, the coolant having flowed back to the coolant storage chamber 52 flows along a second movement direction v2, thereby achieving the purpose of recycling.

In the rectifying inverting element cooling device 4 according to the example of the present disclosure, since the cooling plate 41, the coolant storage assembly 42 and the fan assembly 43 are provided as described above, not only the cooling effect for the rectifying inverting element 3 is increased, but also the whole volume of the VFASIM is reduced. In addition, since the coolant is recyclable, not only the production cost is reduced, but also the wastewater discharge is reduced so as to avoid the environmental pollution.

Figure 13:
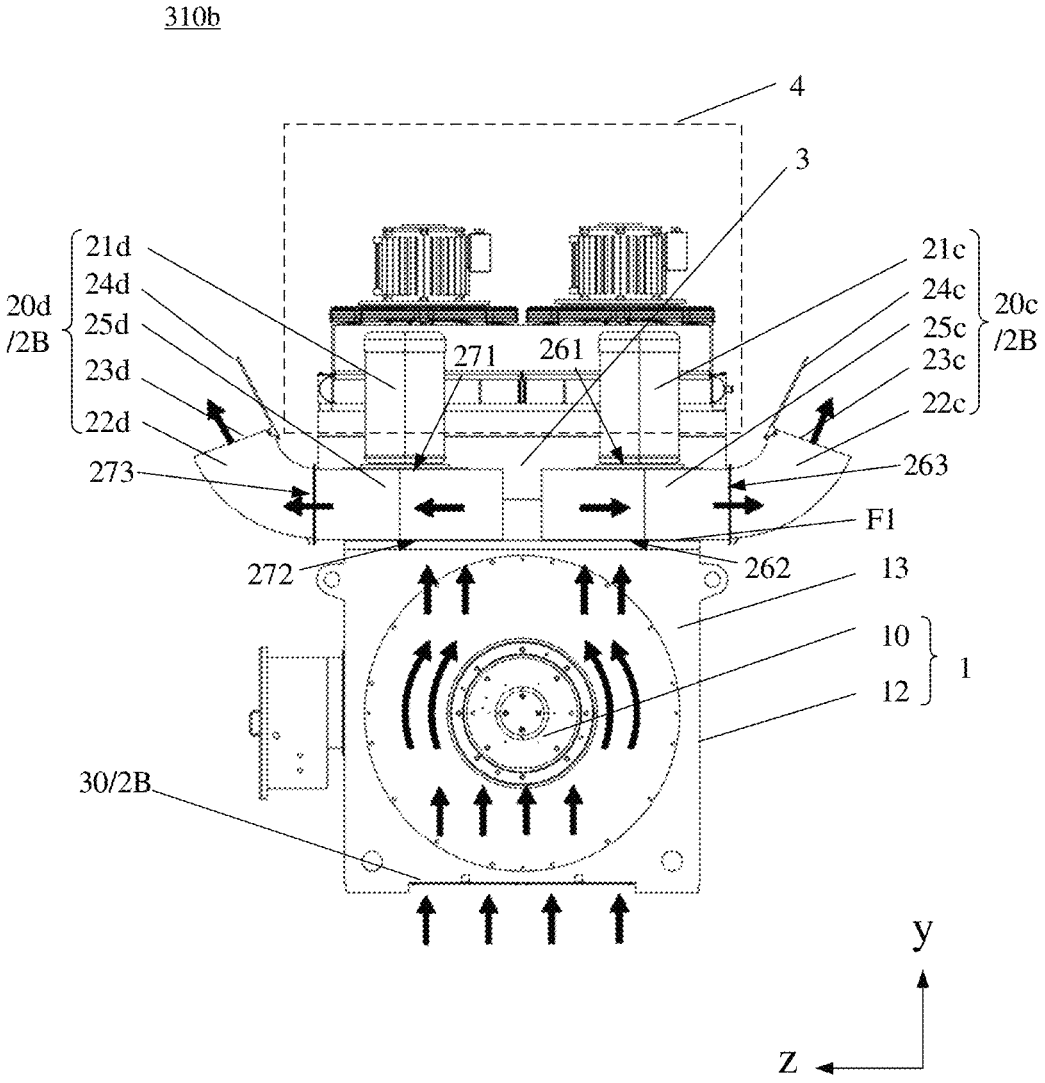
FIG. 13 is a schematic diagram of structure of a VFASIM and its cooling system according to another example of the first embodiment of the present disclosure.

FIG. 13 is a schematic diagram of structure of a VFASIM 310*b* and its cooling system according to another example of the first embodiment of the present disclosure. The VFASIM of FIG. 13 is different from that of FIG. 9 in that, the motor cooling device 2 (i.e., the air cooling mechanism 2B) in FIG. 13 includes a third air-out assembly 20*c* and a fourth air-out assembly 20*d* instead of the first air-out assembly 20*a* and the second air-out assembly 20*b*. The third air-out assembly 20*c* and the fourth air-out assembly 20*d* have the same structure but different air-out directions. As shown in FIG. 13, the air-out port 23*d* for example is opened towards the upper left direction, the air-out port 23*c* for example is opened towards the upper right direction. Other specific structures and arrangement modes may refer to the description in the preceding example, and the description thereof is omitted here.

Figure 14:
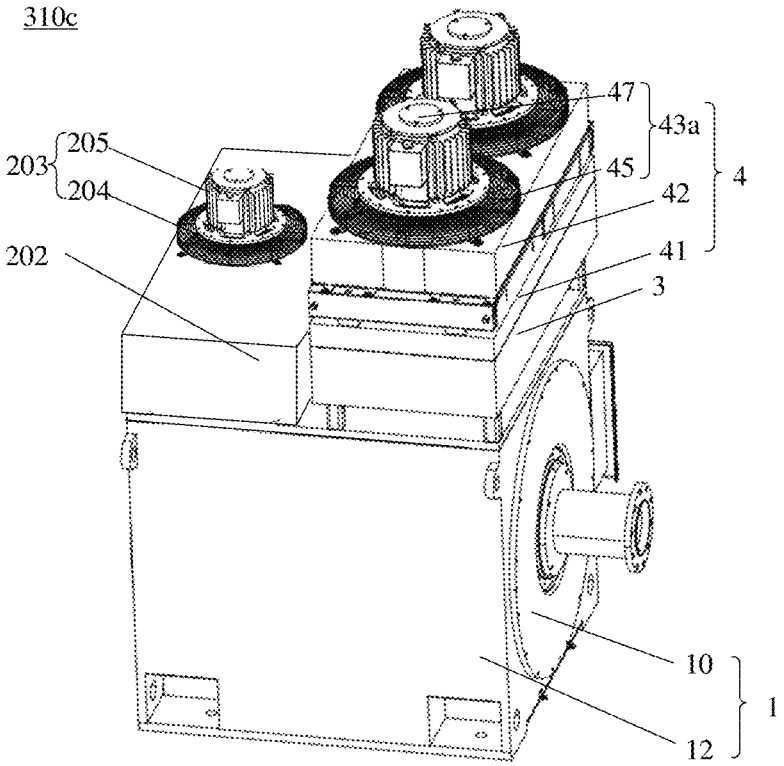
FIG. 14 is a perspective schematic diagram of a VFASIM and its cooling system according to a further example of the first embodiment of the present disclosure.

FIG. 14 is a perspective schematic diagram of a VFASIM and its cooling system according to a further example of the first embodiment of the present disclosure. As shown in FIG. 14, the VFASIM 310*c* provided in the example includes a driving device 1, a motor cooling device 2, a rectifying inverting element 3 and a rectifying inverting element cooling device 4. The motor cooling device 2 includes: a coolant storage assembly 202; and a fan assembly 203 which has a cooling fan 204 and a cooling motor 205. The VFASIM of FIG. 14 is different from that of FIG. 9 in that, in the VFASIM in FIG. 14, both the rectifying inverting element cooling device 4 and the motor cooling device 2 adopt a coolant cooling mode, the coolant cooling systems of these two devices are independent, and each occupies substantively a half of the area on the top surface F1 of the housing 12.

Figure 15:
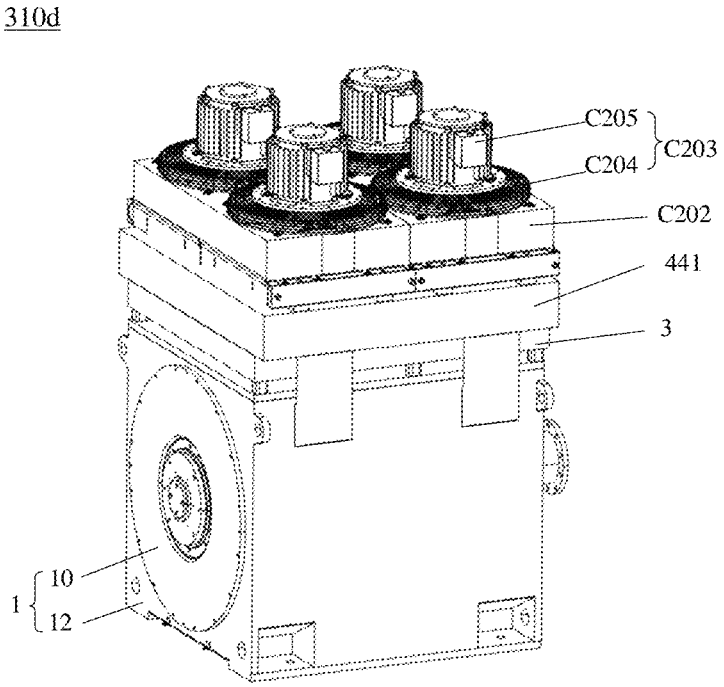
FIG. 15 is a perspective schematic diagram of a VFASIM and its cooling system according to a still further example of the first embodiment of the present disclosure.

FIG. 15 is a perspective schematic diagram of a VFASIM and its cooling system according to a still further example of the first embodiment of the present disclosure. As shown in FIG. 15, the VFASIM 310*d* provided in the example includes a driving device 1, a motor cooling device, a rectifying inverting element 3 and a rectifying inverting element cooling device. In the example, the rectifying inverting element cooling device and the motor cooling device each adopts a coolant cooling mode. These two cooling devices share a cooling plate 441, a coolant storage assembly C202 and a fan assembly C203. The number of the shared fan assembly C203 may be one or more (in FIG. 15, four). Each of the fan assemblies C203 includes a cooling fan C204 and a cooling motor C205.

Figure 16:
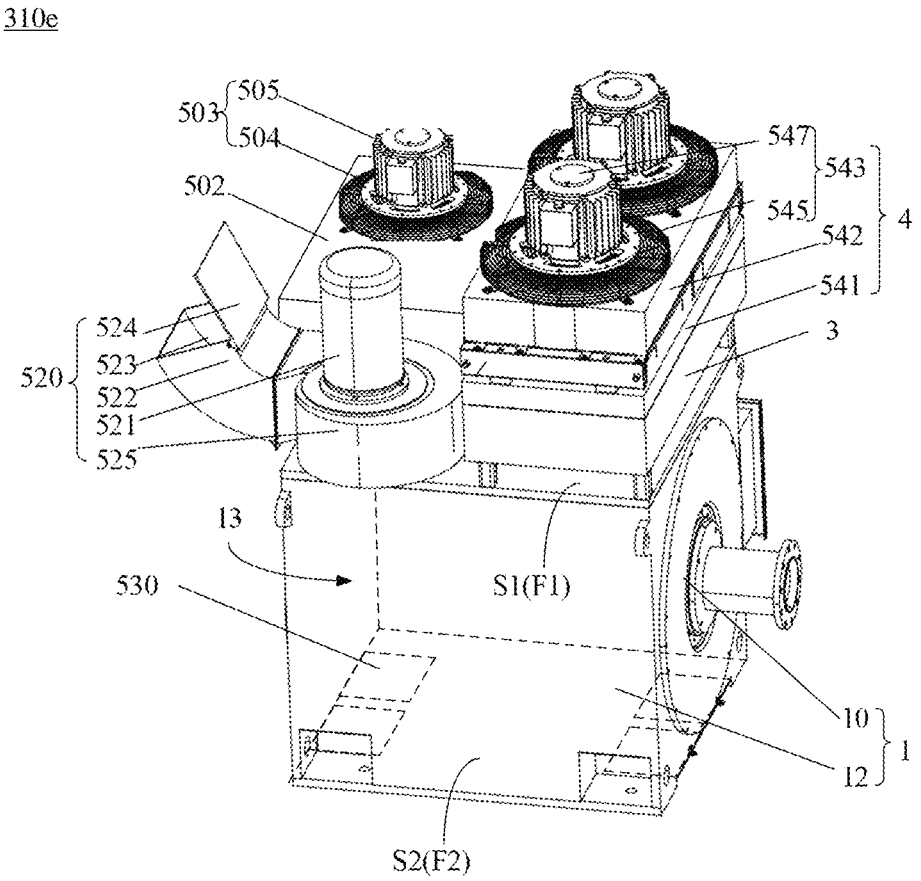
FIG. 16 is a perspective schematic diagram of a VFASIM and its cooling system according to a still further example of the first embodiment of the present disclosure.
Figure 17A:
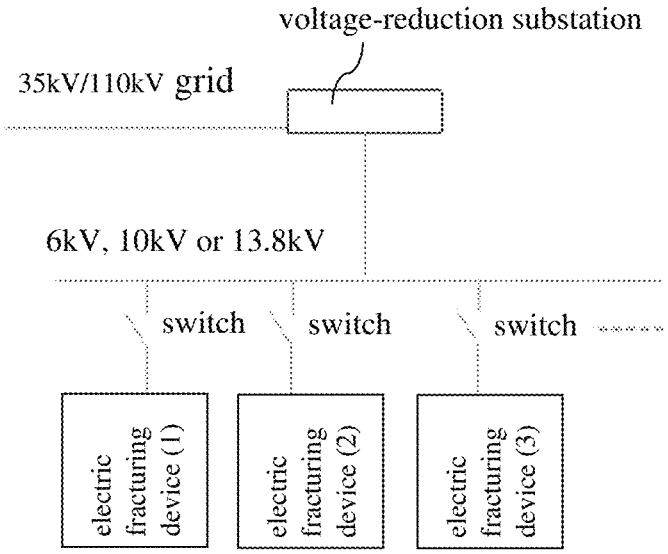
FIGS. 17A to 17F each shows a power supply mode with respect to a fracturing device including the VFASIM and driven by the VFASIM according to a second embodiment of the present disclosure.
Figure 17B:
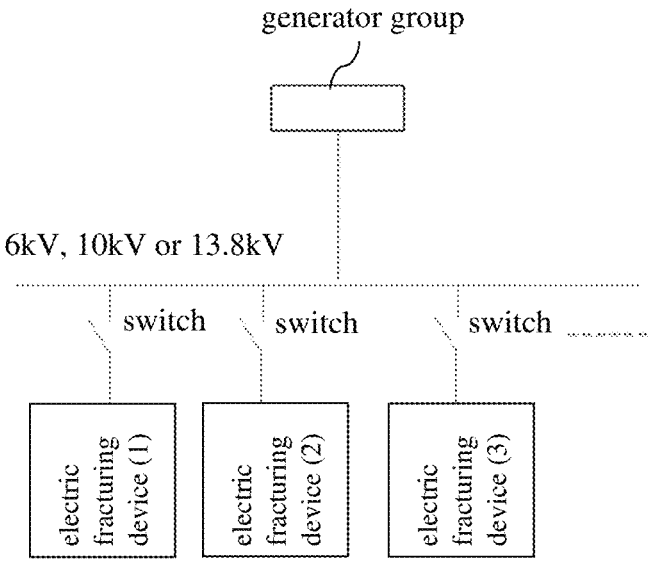
Figure 17C:
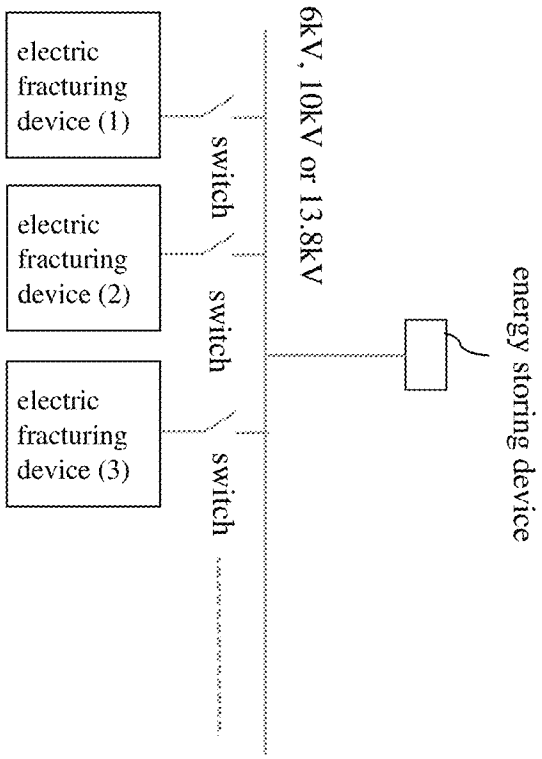
Figure 17D:
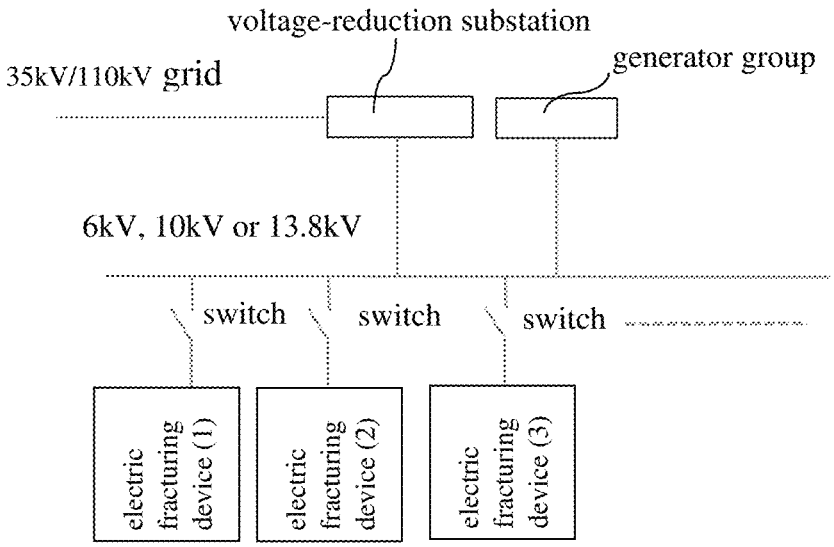
Figure 17E:
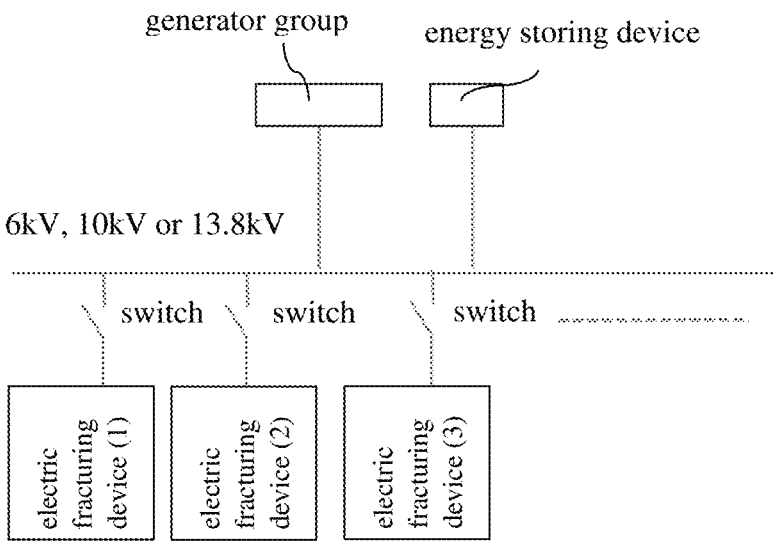
Figure 17F:
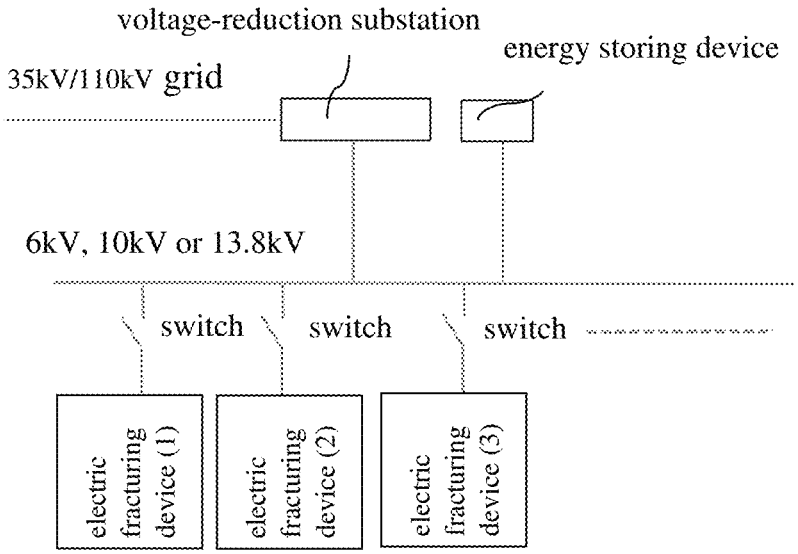

FIG. 16 is a perspective schematic diagram of a VFASIM and its cooling system according to a still further example of the first embodiment of the present disclosure. As shown in FIG. 16, the VFASIM 310*e* provided in the example includes a driving device 1, a motor cooling device 2, a rectifying inverting element 3 and a rectifying inverting element cooling device 4. The VFASIM of FIG. 16 is different from that of FIG. 9 in that, the motor cooling device 2 in FIG. 16 cools the driving device 1 in both an air cooling manner and a coolant cooling manner at the same time. In this case, the motor cooling device 2 includes an air cooling mechanism and a coolant cooling mechanism, wherein the air cooling mechanism has an air-out assembly 520 and an air-in assembly 530, the coolant cooling mechanism has a coolant storage assembly 502 and a fan assembly 503, and the fan assembly 503 includes a cooling fan 504 and a cooling motor 505. Specific structures thereof are described as above. Incidentally, as compared with the coolant storage assembly 202 occupying substantively a half of the top surface area of the housing 12 in FIG. 14, the coolant storage assembly 502 in FIG. 16 occupies a smaller space on the top surface F1 of the housing 12, which allows providing the air-out assembly 520 on the top surface F1.

2.1.4 Power Supply and Control System

About the mode of power supply, a grid (in which the power supply voltage is mainly 10 kV/50 Hz) is widely used in China, but in abroad, a power supply using a power generating equipment (for example, in countries such as US, a voltage of a power generator is generally 13.8 kV/60 Hz) is usually adopted. The VFASIM of the present disclosure has a withstanding voltage performance obtained from parameter adjustment, and can be directly connected to the grid without adjusting the voltage by a transformer.

The fracturing device 100 including the VFASIM 310 and driven by the VFASIM of the present disclosure may be supplied with power from a power grid, a power generator group, an energy storing device or a combination thereof. FIGS. 17A to 17F each shows a power supply mode for a fracturing device including the VFASIM and driven by the VFASIM according to a second embodiment of the present disclosure.

In the present disclosure, since a rectifying transformer is not provided in the power supply path, the power supply becomes much simpler and more convenient. Because there is no rectifying transformer, the amount of wiring is also reduced.

In order to satisfy a requirement of integral control for the fracturing device of the present disclosure, the fracturing device may be provided with various instruments that may allow control systems of the plurality of elements in the fracturing device of the present disclosure to be directly or indirectly integrated, so as to achieve the integral control.

The plurality of elements in the fracturing device 100 of the present disclosure may be provided with a respective control system. For example, a rectifying inverting control system may be provided for the rectifying inverting element 3, and the rectifying inverting control system can control the operating parameters of the rectifying inverting element 3. Further, a plunger pump control system may be provided for the plunger pump 11, and the plunger pump control system can adjust the operating parameters of the plunger pump. The fracturing device 100 of the present disclosure may further include other elements to be used in the fracturing well site and their corresponding control systems.

For example, the fracturing device 100 of the present disclosure may be provided with a centralized control system, the centralized control system and the plunger pump control system are connected for communication, and the plunger pump control system and the rectifying inverting control system are also connected for communication. Therefore, by using the connection for communication between the plunger pump control system and the rectifying inverting control system, it is possible to control the rectifying inverting element 3 via the plunger pump control system, thereby controlling the frequency of the AC output from the rectifying inverting element so as to adjust the rotational speed of the motor 10 in the fracturing device 100. Furthermore, by using the connection for communication between the centralized control system and the plunger pump control system, it is possible to make the centralized control system and the rectifying inverting control system be indirectly connected for communication, so as to control the rectifying inverting element 3 and the plunger pump 11 via the centralized control system, i.e., a remote centralized control is achieved for the fracturing working procedure.

For example, by using a wired network or wireless network, the centralized control system can achieve a connection for communication with the plunger pump control system, the rectifying inverting control system and control systems for other elements in the fracturing device.

For example, in the present disclosure, a remote centralized control for the fracturing working procedure includes: starting/stopping of a motor, rotational speed adjusting of a motor, emergency stop, resetting of a rectifying inverting element, monitoring of key parameters (such as voltage, current, torque, frequency and temperature) and the like. The fracturing device of the present disclosure may include a plurality of plunger pump control systems and a plurality of rectifying inverting control systems. When the plurality of plunger pump control systems and the plurality of rectifying inverting control systems are connected to the centralized control system, the present disclosure can control all of the plunger pumps and the rectifying inverting elements through the centralized control system.

2.1.5 Sleigh Frame for Integration

The supporting frame is used for supporting the above portions of the fracturing device of the present disclosure, and may be in a manner of a sleigh frame, a semi-trailer, a chassis truck or a combination thereof. The sleigh frame may merely have a base plate or a frame without a directly-connected vehicle. FIG. 3 shows a supporting frame 67 located at the bottom of the fracturing device. By using such supporting frame, it is possible to integrate the fracturing device on the supporting frame, and it is possible to allow the integrated fracturing device to be conveniently transported and easily disposed in the well site.

Figure 19:
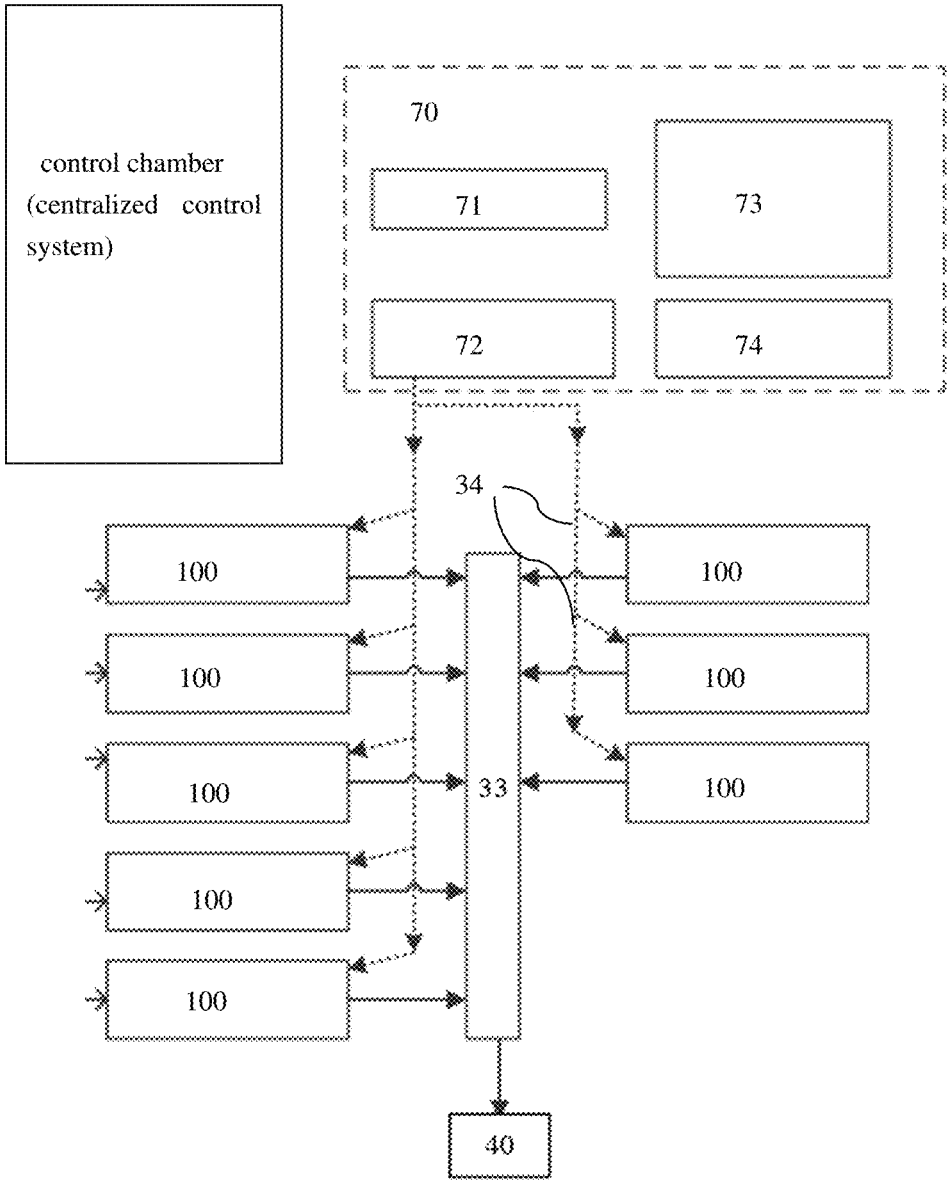
FIG. 19 shows one example of a well site layout for the fracturing device according to one embodiment of the present disclosure.

Further, for example, as shown in FIG. 19, a plurality of low-pressure manifolds 34 (as shown by the dotted arrows) and a high-pressure manifold 33 for a plurality of fracturing devices 100 may be integrally disposed on one manifold sleigh frame (not shown), and the high-pressure manifold 33 is shared by these fracturing devices.

2.2 Operating and Effect of the Fracturing Device

The fracturing device configured by comprising a VFASIM according to the present disclosure includes: the VFASIM, a plunger pump and a control cabinet. The fracturing device of the present disclosure has a configuration in which the VFASIM, the plunger pump and the like are integrated on one supporting frame. The fracturing device may be started, controlled and stopped by the control cabinet. The electric power transported from the power grid may be directly supplied to the VFASIM, or may be supplied to the VFASIM via the control cabinet (after processed by the control cabinet or not processed by the control cabinet). For example, an auxiliary transformer may be provided in the control cabinet and may perform a voltage adjustment on the electric power transported from the power grid, and then may supply it to various electric elements in the fracturing device. Alternatively, the auxiliary transformer provided in the control cabinet may perform a voltage adjustment on the electric power transported from the power grid, and then may supply it to auxiliary elements in the fracturing device except the VFASIM. The VFASIM driven by the electric power supplies a driving force to a transmission input shaft of the plunger pump via a transmission output shaft of the motor. Thus, the plunger pump operates, and the plunger pump, by using its movement, pressurizes a fracturing liquid and then pumps the fracturing liquid with a high pressure to the underground.

In the VFASIM of the fracturing device of the present disclosure, the rectifying inverting element is integrally installed on the motor, and the housing of the rectifying inverting element is closely installed together with the housing of the motor such that an output wiring of the rectifying inverting element is directly joined into the interior of the motor. Since wirings of the rectifying inverting element and the motor are placed inside the motor, interference can be reduced. Especially, when the rectifying inverting element is integrated on the top of the motor, the rectifying inverting element needs not occupy a separate space, thereby extremely saving the installation space and making the whole device more compact.

In the fracturing device of the present disclosure, the VFASIM has a rated frequency which is the same as a frequency of power supply of the power grid, thereby having a withstanding voltage performance instead of additionally adopting a transformer to adjust voltage. It is sufficient that the external wirings of the fracturing device of the present disclosure is joined to one set of high voltage cables, and thus it may be directly connected to the power grid with a high voltage, which simplifies the power supply mode and enhances its adaptiveness.

The fracturing device of the present disclosure has a high degree of integration, and may be easily transported and arranged in the well site under various conditions. Thus, it is possible to achieve a high practicability and general applicability, as well as a low implementation cost when the well site is arranged.

3. Connection Between the VFASIM and the Plunger Pump and Driving Mode Therebetween As described above, the VFASIM 310 and the plunger pump 11 may be directly connected. Their transmission parts may be directly connected with each other by using an internal spline, an external spline, a flat key, a conical key or the like. If there are housings surrounding the respective transmission parts, the housings of the two transmission parts may be connected through a flange, and the flange may have a circle shape, a square shape or any other shape.

In consideration of requirements of different application sites, the VFASIM 310 and the plunger pump 11 may be connected by adopting other connection modes, and then may be integrally installed on the supporting frame. FIGS. 18A to 18E exemplifies examples of several connection modes between the transmission input shaft of the plunger pump 11 and the transmission output shaft of the VFASIM 310.

Figure 18A:
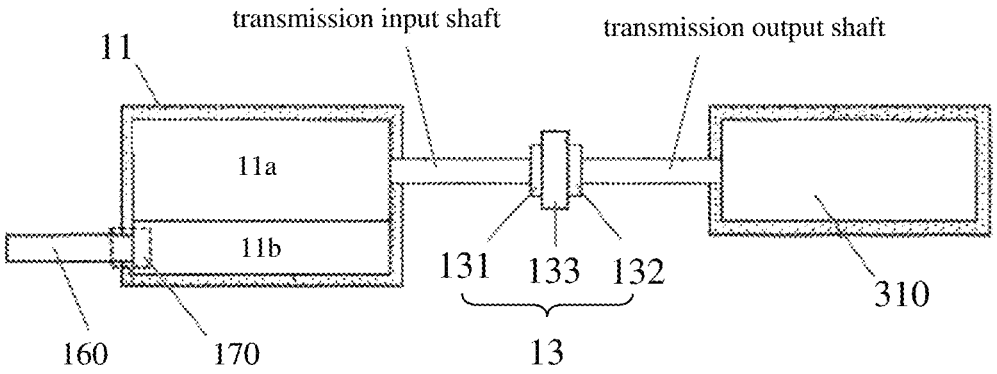
FIGS. 18A to 18E each shows an example of a connection mode between a transmission input shaft of a plunger pump and a transmission output shaft of a VFASIM in a fracturing device according to one embodiment of the present disclosure.

As shown in FIG. 18A, the fracturing device 100 according to one example of the present disclosure includes the plunger pump 11 and the VFASIM 310. The plunger pump 11 includes a power end 11*a* and a hydraulic end 11*b*. A fracturing liquid output end 170 is provided at a side of the hydraulic end 11*b*, and a discharge manifold 160 of the plunger pump 11 extends outwards from the fracturing liquid output end 170. The plunger pump 11 also includes a transmission input shaft extending outwards from the power end 11*a*, and the transmission input shaft of the plunger pump 11 and a transmission output shaft of the VFASIM 310 may be connected via a clutch 13. Specifically, the clutch 13 includes a first connection section 131, a second connection section 132 and a clutching section 133 located between the first connection section 131 and the second connection section 132. The transmission input shaft of the plunger pump 11 is connected to the first connection section 131, and the second connection section 132 is connected to the transmission output shaft of the VFASIM 310. A protective cover may be provided surrounding the clutch 13 to protecting the clutch, and the front and rear ends of the protective cover are respectively closely connected to a housing surrounding the transmission input shaft of the plunger pump 11 and a housing surrounding the transmission output shaft of the VFASIM 310. Here, a clutch with a very high stability may be adopted, on one hand, for maintaining the plunger pump to stably and continuously operate during the fracturing working procedure, and on the other hand, for avoiding the clutch from being damaged even if it needs to frequently attach or detach the plunger pump.

Figure 18B:
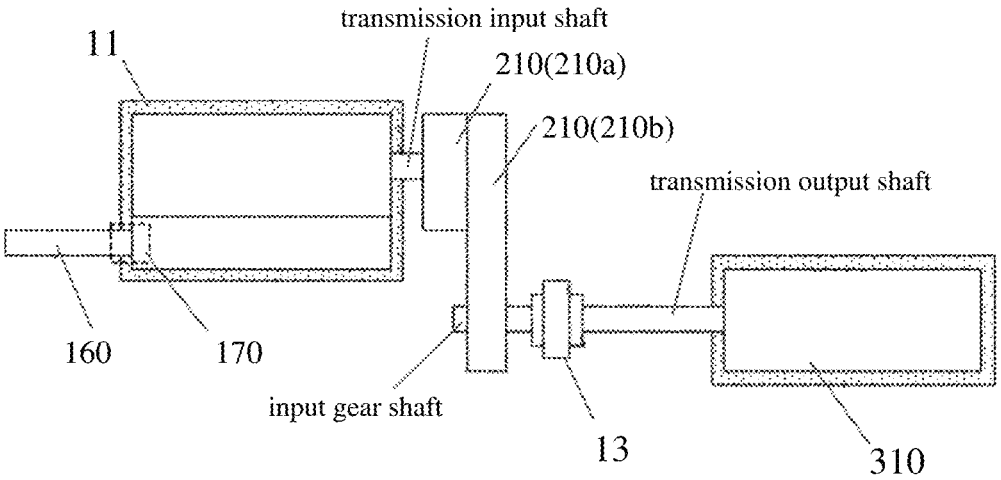

As shown in FIG. 18B, the fracturing device 100 according to one example of the present disclosure may include a gearbox 210, in addition to sections same as those in FIG. 18A. An input gear shaft is provided on the gearbox 210. One end of the input gear shaft is connected to the first connection section 131 of the clutch 13, and another end of the input gear shaft is connected to the gearbox 210. The gearbox 210 may include a planet gear 210*a* and a parallel-axis gear 210*b*. The parallel-axis gear 210*b* is connected to the above another end of the input gear shaft, and the planet gear 210*a* is connected to the transmission input shaft of the plunger pump 11.

Further, in the fracturing device 100, a quick connection/disconnection mechanism is provided at a connection section between the plunger pump 11 and the gearbox 210. The bottom of the plunger pump 11 is installed as an assembled structure on the base of the device, and a lifting mechanism is provided at the installation position of the plunger pump. When it is necessary to detach and update a certain plunger pump, the plunger pump is firstly stopped to operate by using the control system, is disconnected from the gearbox 210 by using the quick connection/disconnection mechanism, and then is taken off from the base of the device and moved to a specific position by using the lifting mechanism. After that, a new plunger pump is lifted to mount on the base of the device, and then is connected to the gearbox by using the quick connection/disconnection mechanism. Finally, this plunger pump is started by using the control system.

3.1 Example in which a Single Pump is Driven by a Single Motor

In the fracturing device driven by a VFASIM according to the present disclosure, in order to improve the individual power of the plunger pump, a design solution in which a single plunger pump is driven by a single motor may be adopted, as shown in FIGS. 18A and 18B. By doing this, the whole structure of the fracturing device becomes simpler and the output power of the fracturing device is significantly improved at the same time. Such a fracturing device can desirably satisfy the usage requirement. It should be noted that the clutch 13 can also be replaced by a coupler.

3.2 Example in which Multiple Pumps are Driven by a Single Motor

Figure 18C:
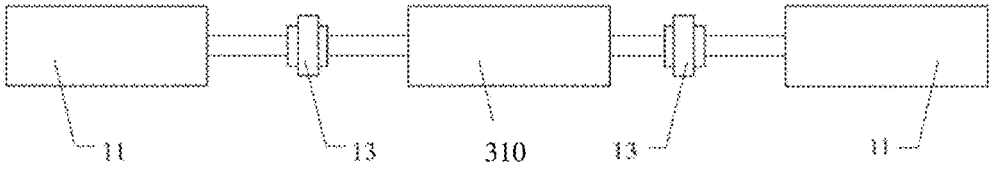
Figure 18D:
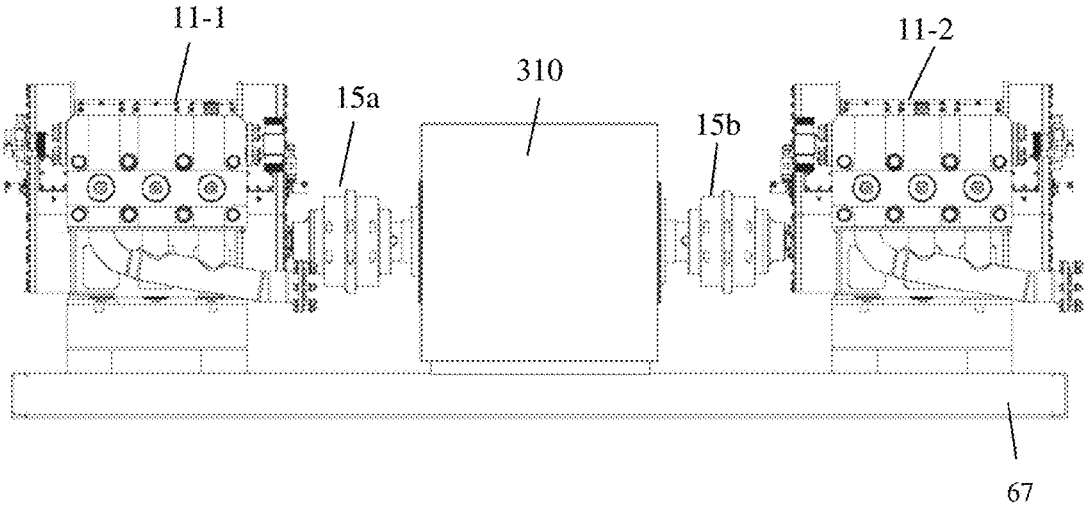
Figure 18E:
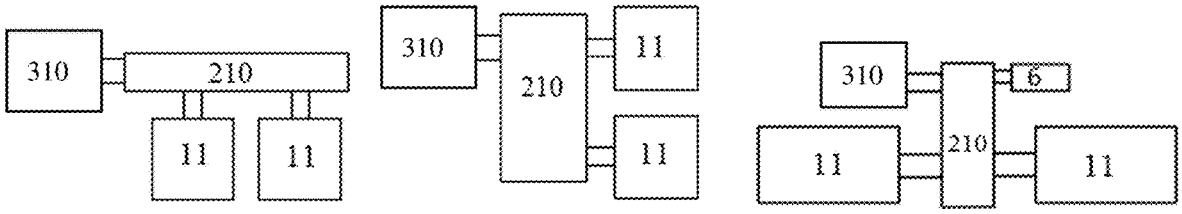

In the fracturing device driven by a VFASIM according to the present disclosure, in order to save the occupied area, a design solution in which a plurality of plunger pumps are driven by a single motor may be adopted. FIGS. 18C to 18E each shows a connection mode in which the plurality of (two or more) plunger pumps are driven by one motor.

As shown in FIG. 18C, the fracturing device 100 according to one example of the present disclosure includes two plunger pumps 11 and one VFASIM 310, and in this way, one VFASIM 310 can simultaneously drive two plunger pumps 11. At this time, the fracturing device 100 may include at least one clutch 13, e.g., two clutches 13. Thus, when it is detected that any one of the two plunger pumps 11 cannot work normally, it is possible to control the corresponding clutch to detach the plunger pump, so as to ensure a normal operation of another plunger pump.

In FIG. 18D, the fracturing device 100 according to one example of the present disclosure also includes one VFASIM 310 and two plunger pumps 11 (11-1 and 11-2). Couplers 15*a* and 15*b* are respectively provided between the VFASIM 310 and the plunger pump 11-1 and between the VFASIM 310 and the plunger pump 11-2. For each of the couplers, its one side is connected to the transmission output shaft (a driving shaft) of the VFASIM 310, and another side is connected to the transmission input shaft (a driven shaft) of the plunger pump (11-1 or 11-2). The coupler makes the driving shaft and the driven shaft rotate in conjunction with each other and transfers a torque. The plunger pump may be quickly attached or detached by using the coupler, and a manufacturing variation or a relevant shift between the driving shaft and the driven shaft may be compensated by the coupler.

FIGS. 18A, 18C and 18D are examples in which a single-shaft output is achieved between the motor and the plunger pump(s). FIGS. 18B and 18E are examples in which a single-shaft output or a multiple-shaft output is achieved between the motor and the plunger pump(s). In the case of multiple-shaft output, the transmission output shaft of one motor may be connected to various plunger pumps via the gearbox 210.

For example, as shown in FIG. 18E, a VFASIM 310 is connected to the input end of the gearbox 210, the gearbox 210 has at least two output ends, and each of plunger pumps 11 is connected to a corresponding output end of the gearbox 210. A transmission device may be adopted to connect the plunger pump 11 to the gearbox 210. For example, the gearbox 210 is provided with a clutch at each of its output ends, so as to achieve an independent control of each output end and achieve a quick detachment and update of each plunger pump 11. The layout of the plurality of plunger pumps 11 with respect to the gearbox 210 may be adaptively disposed as actual requirements. For example, the plunger pumps 11 may be arranged side by side along the extension direction of the transmission output shaft of the VFASIM 310 and be disposed on the same output side of the gearbox 210 (as shown in (a) of FIG. 18E), or may be arranged side by side along a direction perpendicular to the extension direction of the transmission output shaft of the VFASIM 310 and be disposed on the same output side of the gearbox 210 (as shown in (b) of FIG. 18E). Alternatively, the plunger pumps 11 may be disposed on different output sides of the gearbox 210 (as shown in (c) of FIG. 18E). A power takeoff (PTO) port may be further provided on the VFASIM 310 or the gearbox 210, and for example, a lubrication motor 6 may be driven by using the PTO port so as to supply a driving power for the lubrication system (as shown in (c) of FIG. 18E).

3.3 Example in which the Motor is Replaced by a Turbine

The examples in which the fracturing device is driven by adopting the VFASIM have been described in the above embodiments and examples thereof, but the VFASIM may be replaced with a turbine. An overall layout with a high degree of integration may be also obtained by integrally installing the turbine with the plunger pump of the fracturing device together.

The fracturing device according to the technology has been exemplarily described above, and the application example of the fracturing device in the well site will be described next.

4. Well Site Layout for the Fracturing Device

FIG. 19 shows one example of a well site layout for the fracturing device according to one embodiment of the present disclosure. In the well site layout, the plurality of fracturing devices 100 each has its own low-pressure manifold 34, but share one high-pressure manifold 33. The fracturing liquid with a high pressure output from each fracturing device 100 enters into the high-pressure manifold 33, and is delivered to the well port 40 through the high-pressure manifold 33 so as to inject to the underground. All manifolds may be integrated on one manifold sleigh frame, for the sake of integrally monitoring and managing.

In some examples, as shown in FIG. 19, the well site layout also includes a liquid preparing region 70. The liquid preparing region 70 may include a liquid mixer 71, a sand mixer 72, a liquid tank 73, a sand storing and adding device 74 and the like. In some cases, the fracturing liquid injected into the downhole is a sand-carrying liquid. It needs to mix water, sand and chemical additive(s) to make sand suspend in the fracturing liquid. For example, clear water and chemical additive(s) may be mixed in the liquid mixer 71 so as to form a mixed liquid, and the mixed liquid in the liquid mixer 71 and sand from the sand storing and adding device 74 are supplied into the sand mixer 72 to mix herein. Thus, the sand-carrying fracturing liquid needed in the working procedure is formed. The fracturing liquid with a low pressure formed in the sand mixer 72 is transferred to a liquid inlet of the fracturing device 100, and the fracturing device 100 pressurizes the fracturing liquid with the low pressure and then transfers it to the high-pressure manifold 33.

For example, the power of the liquid mixer 71, the sand mixer 72, the sand storing and adding device 74 and the like may be supplied from a power supply device such as the control cabinet in the well site.

In some examples, as shown in FIG. 19, the well site layout usually includes a control chamber, and a centralized control system is provided in the control chamber to control all of the plunger pumps, the VFASIM and the like.

5. Other Modification Examples

Figure 20:
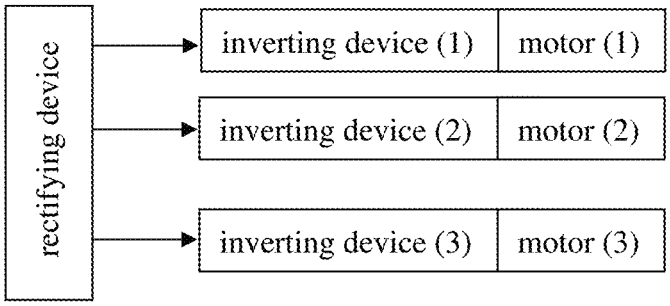
FIG. 20 shows an example in which one rectifying device is connected to a plurality of inverting devices each integrated on a corresponding motor according to one embodiment of the present disclosure.

FIG. 20 shows an example in which one rectifying device is connected to a plurality of inverting devices integrated on corresponding motors according to one embodiment of the present disclosure. The rectifying device includes an input end and a plurality of output ends, each of the inverting devices includes an input end and an output end, the output ends of the rectifying device each is connected to the input end of one corresponding inverting device, the output end of each inverting device is connected to the input terminal of the corresponding motor. By connecting one rectifying device to the plurality of inverting devices, it is possible to reduce the number of rectifying devices, so that the well site layout has a smaller occupied area and is more economical.

The rectifying device may be provided in the control cabinet, and each inverting device is integrated on the corresponding motor. Since only the inverting device is integrally provided on the motor, it can further reduce the weight of the VFASIM, save the occupied space of the VFASIM. This helps to optimize the layout of elements such as the motor and the inverters in the VFASIM, or helps to arrange other elements. Since the inverting devices are integrally provided on the corresponding motors, there is no need to connect the wirings of the inverting device and the motor before every fracturing operation, which reduces the complexity of operation.

For example, FIG. 20 may be applied to the well site layout in FIG. 19. In this case, the fracturing devices 100 in FIG. 19 may be divided into three groups, among which two groups each includes three inverting devices and three motors, the remaining one group includes two inverting devices and two motors. Each group is provided with one rectifying device. By doing so, when eight fracturing devices 100 operate, it is sufficient to arrange three rectifying devices. Thus, the number of rectifying devices is significantly reduced, and the occupied area of the well site and cost are reduced. It should be noted that the number of the fracturing devices 100 shown in FIG. 19 and the number of the inverting devices sharing one rectifying device shown in FIG. 20 are merely examples, but the present disclosure is not limited hereto.

The elements or sections in each of embodiments or examples of the present disclosure may be combined with each other or be replaced as necessary, and are not limited to the specific examples described above.

It should be understood that persons skilled in the art can obtain various modification, combination, sub-combination and change according to design requirements and other factors, and all of these fall into scopes of the attached claims and equivalents.

The invention claimed is:

1. A fracturing device, comprising:

a variable-frequency adjustable-speed integrated machine (VFASIM) including:

a plurality of driving devices including a first driving device for providing a driving force; and a plurality of inverting devices including a first inverting device installed on the first driving device and configured to supply power to the first driving device;

a rectifying device provided inside or outside the VFASIM, wherein the rectifying device is configured to provide power to the inverting devices; and a plunger pump mechanically connected to the first driving device of the VFASIM and is driven by the first driving device, wherein an input terminal of each of the plurality of inverting devices is connected to the rectifying device, and an output terminal of each of the plurality of inverting devices is connected to a corresponding one of the plurality of driving devices.

2. The fracturing device according to claim 1, wherein:

the first inverting device comprises a first housing;

the first driving device comprises a second housing;

the first and second housings are fixedly connected directly or fixedly connected via a mounting flange;

a plurality of holes or a plurality of wiring columns are provided in one or more connection surfaces of the first and second housings;

an output terminal of the first inverting device is connected to an interior of the first driving device via the plurality of holes or the plurality of wiring columns; and a transmission output shaft of the first driving device protrudes from a side of the second housing of the first driving device different from the connection surface.

3. The fracturing device according to claim 1, wherein:

a transmission output shaft of the first driving device is directly and mechanically connected to a transmission input shaft of the plunger pump; the transmission output shaft of the first driving device includes a first internal spline, a first external spline, a first flat key, or a first conical key; and the transmission input shaft of the plunger pump includes a second external spline, a second internal spline, a second flat key, or a second conical key.

4. The fracturing device according to claim 1, wherein:

a transmission output shaft of the first driving device is connected to a transmission input shaft of the plunger pump via a gearbox or a coupler;

the transmission output shaft of the first driving device includes a first housing;

the transmission input shaft of the plunger pump includes a second housing; and the first and second housings are fixedly connected directly or fixedly connected via a mounting flange at a connection side.

5. The fracturing device according to claim 1, wherein:

a transmission output shaft of the first driving device is (i) directly and mechanically connected to a transmission input shaft of the plunger pump, or (ii) connected to the transmission input shaft of the plunger pump via a gearbox or a coupler; and the fracturing device further comprising a lubrication system including: a lubrication oil tank for storing and supplying a lubrication oil, and a group of lubrication motor and lubrication pump connected to the lubrication oil tank, wherein the group of lubrication motor and lubrication pump is configured to cycle the lubrication oil, wherein a direction along the transmission input shaft of the plunger pump is a length direction, a horizontal direction perpendicular to the length direction is a width direction, a direction perpendicular to both the length direction and the width direction is a height direction, and the lubrication system is provided at one side of the VFASIM in the width direction.

6. The fracturing device according to claim 5, further including:

a lubrication oil cooling system provided at a top of the plunger pump in the height direction or a side of the VFASIM in the width direction, wherein the lubrication oil cooling system includes a lubrication oil radiator, a cooling motor, and a cooling fan driven by the cooling motor, and the cooling fan performs heat exchange between air and the lubrication oil entering into the lubrication oil radiator.

7. The fracturing device according to claim 6, wherein:

the lubrication oil radiator is a horizontal radiator, a vertical radiator, or a tetragonal radiator.

8. The fracturing device according to claim 5, wherein:

when the transmission output shaft is directly mechanically connected to the transmission input shaft, the lubrication system includes a group of lubrication motor and lubrication pump for supplying lubrication to a power end of the plunger pump, or when the transmission output shaft is connected to the transmission input shaft via the gearbox or the coupler, the lubrication system includes a first group of lubrication motor and lubrication pump for supplying lubrication to a power end of the plunger pump and a second group of lubrication motor and lubrication pump for supplying lubrication to the gearbox or the coupler.

9. The fracturing device according to claim 5, further comprising:

a VFASIM cooling system which is at least partly provided at a side of the VFASIM in the width direction or at a top of the VFASIM in the height direction.

10. The fracturing device according to claim 9, wherein:

the first driving device includes a motor and a housing containing the motor;

the first inverting device is installed on a top surface of the housing of the first driving device;

the VFASIM cooling system includes: (i) a driving device cooling system at least partly provided on the top surface of the housing of the first driving device, or (ii) an inverting device cooling system provided on a top surface of the first inverting device;

the driving device cooling system includes an air cooling device, a coolant cooling device, or a combination thereof;

the inverting device cooling system includes a coolant-based cooling device; and the coolant-based cooling device includes a horizontal radiator, a vertical radiator, or a tetragonal radiator.

11. The fracturing device according to claim 10, wherein:

the coolant cooling device includes:

a cooling plate provided on the top surface of the housing of the first driving device or the top surface of the first inverting device, and directly contacting the housing of the first driving device or the first inverting device;

a coolant storage chamber for storing a coolant and supplying the coolant into the cooling plate; and a fan assembly for cooling the coolant in the coolant storage chamber;

the cooling plate includes a cooling channel through which the coolant flows;

the cooling channel including at least one cooling pipe as well as a cooling channel inlet and a cooling channel outlet both being communicated with the cooling pipe;

the cooling channel inlet and the cooling channel outlet are respectively communicated with an output port and an input port of the coolant storage chamber; and the at least one cooling pipe shares the cooling channel inlet and the cooling channel outlet.

12. The fracturing device according to claim 10, wherein:

the air cooling device includes:

an air-out assembly communicated with a cavity defined by the housing of the first driving device; and an air-in assembly including an air-in port provided a side of the housing different from a side where the air-out assembly is provided, wherein air entered into the cavity via the air-in port is discharged via the air-out assembly;

the air-out assembly includes:

a cooling fan provided on the housing of the first driving device;

a fan volute provided between the cooling fan and the housing; and an air-discharging duct;

a first side of the fan volute is communicated with the cooling fan;

a second side of the fan volute is communicated with the cavity;

a third side of the fan volute is communicated with the air-discharging duct, wherein air sucked into the fan volute from the cavity is discharged through the air-discharging duct;

the air-discharging duct includes an air-out port towards a direction away from the housing; and the air-in assembly is provided with a protective screen for covering the air-in port.

13. The fracturing device according to claim 12, wherein:

the air-in assembly is provided as at least two air-in assemblies, the at least two air-in assemblies are provided at different positions on a bottom surface of the housing.

14. The fracturing device according to claim 5, further including:

a control cabinet, through which electric power from a power supply system is input to the fracturing device, the control cabinet being provided at a side of the VFASIM opposite to a side where the plunger pump is provided or being provided at a side of the plunger pump opposite to a side where the VFASIM is provided;

a low-pressure manifold, via which a fracturing liquid is supplied to a hydraulic end of the plunger pump, the low-pressure manifold being provided at a side of the plunger pump in the width direction;

a high-pressure manifold, via which the fracturing liquid is discharged to outside of the plunger pump from an output port of the hydraulic end of the plunger pump after the fracturing liquid being pressurized by movement of the plunger pump, the high-pressure manifold being provided at one or more ends of the plunger pump in the length direction; and an auxiliary transformer is provided in the control cabinet and configured to perform a voltage adjustment on an electric power from the power supply system and supply the electric power to the fracturing device.

15. The fracturing device according to claim 14, further including:

a supporting frame located at a bottom of the fracturing device for installing the fracturing device, wherein the supporting frame is in a form of sleigh frame, semi-trailer, or chassis truck.

16. The fracturing device according to claim 15, wherein:

the first driving device and the plunger pump driven by the first driving device are integrated on the supporting frame, or the first driving device and a plurality of plunger pumps including the plunger pump driven by the first driving device are integrated on the supporting frame.

17. A well site layout, including:

a plurality of fracturing devices each according to claim 14; and a control chamber;

wherein:

a centralized control system is provided in the control chamber and configured to centrally control each of the plurality of fracturing devices; or electric power supplied from the power supply system is centrally supplied to each of the plurality of fracturing devices via the control chamber.

18. The well site layout according to claim 17, wherein:

the fracturing device is supplied with electric power by a power supply system, the power supply system being a power grid, a power generating equipment, or an energy storing device;

the high-pressure manifold is shared by the plurality of fracturing devices; and the low-pressure manifold and the high-pressure manifold are installed on one manifold sleigh frame.

* * * * *